US008764159B2

(12) United States Patent
Maida

(10) Patent No.: US 8,764,159 B2
(45) Date of Patent: Jul. 1, 2014

(54) HEAD CLEANING DEVICE, IMAGE FORMING APPARATUS, AND HEAD CLEANING METHOD

(75) Inventor: Noriaki Maida, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/286,674

(22) Filed: Nov. 1, 2011

(65) Prior Publication Data

US 2012/0105538 A1 May 3, 2012

(30) Foreign Application Priority Data

Nov. 2, 2010 (JP) ..... P2010-246446

(51) Int. Cl.
*B41J 2/165* (2006.01)

(52) U.S. Cl.
USPC ..... 347/21

(58) Field of Classification Search
None
See application file for complete search history.

(56) References Cited

U.S. PATENT DOCUMENTS

| | | | | |
|---|---|---|---|---|
| 4,528,996 | A | 7/1985 | Jones | |
| 6,183,058 | B1 | 2/2001 | Sharma et al. | |
| 2009/0046122 | A1* | 2/2009 | Inoue | 347/33 |
| 2010/0214356 | A1 | 8/2010 | Maida et al. | |
| 2010/0245464 | A1 | 9/2010 | Maida | |
| 2011/0234696 | A1* | 9/2011 | Inoue | 347/33 |

FOREIGN PATENT DOCUMENTS

| | | | |
|---|---|---|---|
| EP | 1074389 | A2 | 2/2001 |
| JP | 2001-130015 | A | 5/2001 |

OTHER PUBLICATIONS

Extended European Search Report for European Application No. 11187535.7, dated Feb. 10, 2012.

* cited by examiner

*Primary Examiner* — Alejandro Valencia
(74) *Attorney, Agent, or Firm* — Birch, Stewart, Kolasch & Birch, LLP

(57) ABSTRACT

A head cleaning device includes: a cleaning liquid holding unit provided with a cleaning liquid holding surface inclined corresponding to the nozzle surface of an ink jet head obliquely disposed; movement unit moving a head with respect to the cleaning liquid holding unit; and a cleaning liquid supply unit that supplies cleaning liquid from the upper portion of inclination so as to slide down the inclination of a cleaning liquid holding surface while cleaning liquid forms a meniscus between the cleaning liquid holding surface and the nozzle surface, in a state where the cleaning liquid holding surface and the nozzle surface face each other, and includes cleaning liquid nozzles disposed so that a position of the outer edge on the downstream side of the head in a movement direction is located further to the upstream side than the center in a head movement direction of the cleaning liquid holding surface.

9 Claims, 11 Drawing Sheets

HEAD CLEANING DEVICE, IMAGE FORMING APPARATUS, AND HEAD CLEANING METHOD

BACKGROUND OF THE INVENTION

1. Field of the Invention

The present invention relates to a head cleaning device, an image forming apparatus, and a head cleaning method, and particularly to a cleaning technique of a liquid ejection surface of an ink jet head.

2. Description of the Related Art

As general-purpose image forming apparatuses, ink jet recording apparatuses that eject liquid from an ink jet head to form an image on a predetermined medium have been known. When an ink jet head is operated for a long period of time, solidified ink or paper dust of mediums and the like are attached to the ink ejection surface (nozzle surface) of the ink jet head. Particularly, when attached substances are attached to a nozzle opening for ink ejection or the vicinities thereof, abnormal ejection such as a deflection of the flight of ink or a reduction in the ejection amount occurs, and thus the image quality is deteriorated. In order to avoid such abnormal ink ejection, maintenance is periodically performed on the ink ejection surface of the ink jet head.

JP2001-130015A discloses a printing system for effectively removing foreign substances attached to a head surface of a printing head having a page width. Such a printing system is configured so that a cleaning cup is brought into contact with a printing head surface in which ink ejection orifices are opened, and the flow of cleaning liquid in the inside of the cleaning cup is switched from a first direction to a second direction opposite to the first direction, to thereby accelerate the cleaning liquid and generate shearing force in the flow of the cleaning liquid, and thus cleaning of the printing head surface is performed by causing the shearing force to act on the head surface.

As means for transporting a medium, a drum transport system that fixes a medium to the outer circumference surface of a cylindrically-shaped transport drum and rotates the transport drum to thereby move the medium in the circumferential direction of the transport drum is known. In such a drum transport system, a head is disposed so as to be inclined with respect to the horizontal plane so that the nozzle surface of the head and the medium (outer circumference surface of the transport drum) are parallel to each other. By adopting such an arrangement, cleaning liquid flows from the upper side of inclination to the lower side thereof when the cleaning liquid is supplied to the inclined nozzle surface, and thus it is difficult to uniformly supply the cleaning liquid to the entirety of the nozzle surface.

On the other hand, when a cleaning structure of a printing head according to JP2001-130015A is applied to the cleaning of the ink jet head disposed obliquely to the horizontal plane, corresponding to the drum transport system, there may be a case in which the cleaning liquid flows in the obliquely upward direction. When the flow of the cleaning liquid in the obliquely upward direction and the flow thereof in the obliquely downward direction occur, it is considered that a desired effect is not easily obtained.

The present invention is contrived in view of such circumstances, an object thereof is to provide a head cleaning device and an image forming apparatus and a head cleaning method which are capable of uniformly supplying cleaning liquid over the entirety of the nozzle surface of the head disposed so as to be obliquely inclined with respect to the horizontal plane.

SUMMARY OF THE INVENTION

In order to achieve the above-mentioned object, there is provided a head cleaning device including: cleaning liquid holding unit that includes a cleaning liquid holding surface which is inclined with respect to a horizontal plane, corresponding to a liquid ejection surface of an ink jet head inclined with respect to a horizontal plane, and has a structure in which the cleaning liquid holding surface and the liquid ejection surface are disposed so as to have a gap therebetween, in a state where the cleaning liquid holding surface and the liquid ejection surface face each other; relative movement unit that relatively moves the inkjet head with respect to the cleaning liquid holding unit, while the liquid ejection surface of the ink jet head and the cleaning liquid holding surface face each other, and the gap between the liquid ejection surface and the cleaning liquid holding surface is constantly maintained; and cleaning liquid supply unit that includes a cleaning liquid supply port for supplying cleaning liquid from the upper portion of an inclination of the cleaning liquid holding surface to the cleaning liquid holding surface, in a state where the cleaning liquid holding surface and the liquid ejection surface face each other, wherein the cleaning liquid supply unit has a structure in which the outer edge on the downstream side in a movement direction, when the cleaning liquid holding unit of the cleaning liquid supply port is fixed and the ink jet head is moved, is disposed further to the upstream side than the center in the movement direction of the cleaning liquid holding surface.

According to the present invention, the cleaning liquid supplied from the cleaning liquid supply port to the cleaning liquid holding surface is drawn to the relative movement direction by the relative movement of the ink jet head and the cleaning liquid holding unit, not to thereby flow out from the end of the cleaning liquid holding surface in the relative movement direction, a meniscus is formed between the cleaning liquid holding surface and the liquid ejection surface from the upper portion of the inclination of the cleaning liquid holding surface to the lower portion thereof, and thus a preferable supply of the cleaning liquid to the liquid ejection surface is realized.

DESCRIPTION OF THE PREFERRED EMBODIMENTS

Hereinafter, a preferred embodiment of the present invention will be described in detail with reference to the accompanying drawings.

[Overall Configuration of Ink Jet Recording Apparatus]

Figure 1:
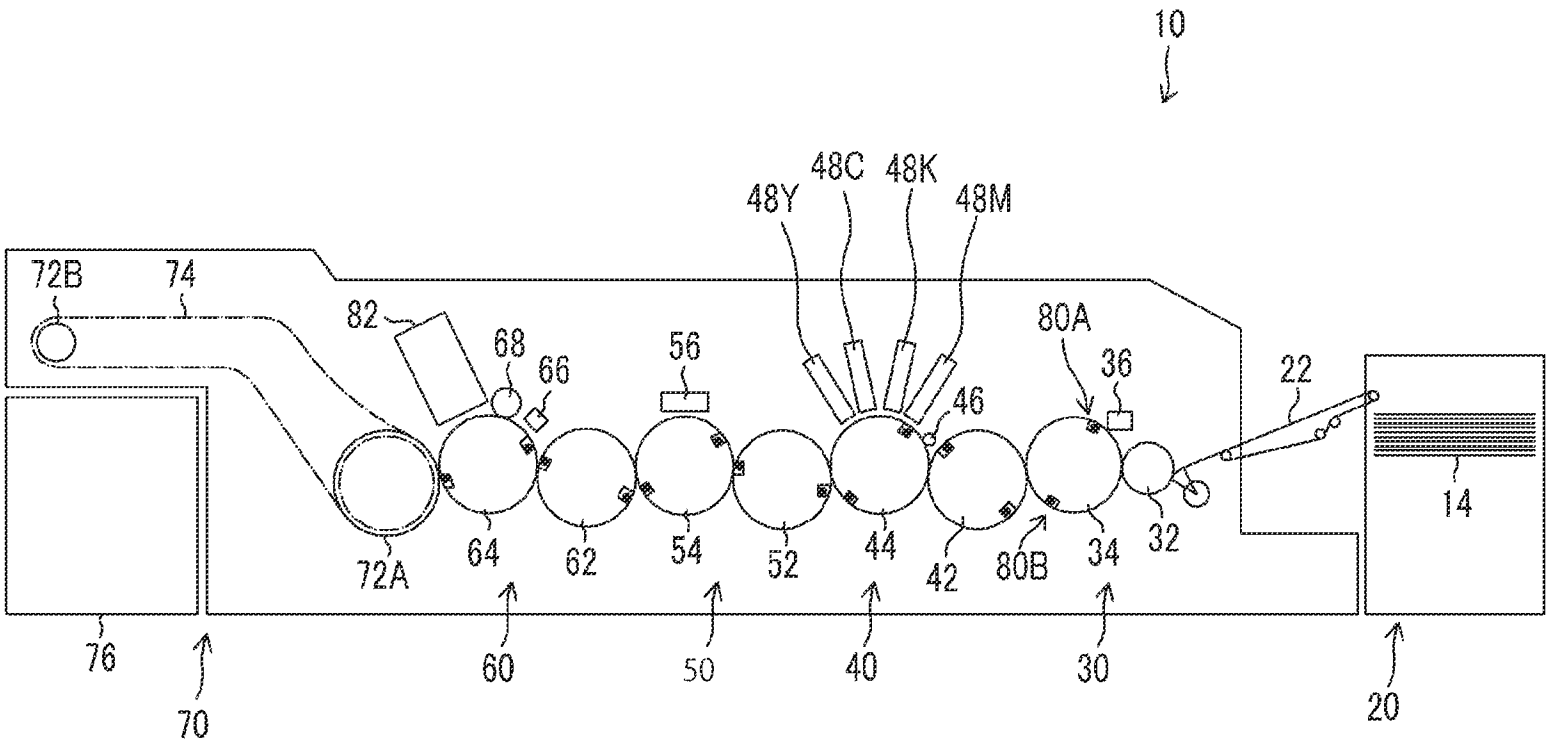
FIG. 1 is an overall configuration diagram illustrating a schematic configuration of an ink jet recording apparatus including a head cleaning device according to the present invention.

FIG. 1 is a configuration diagram illustrating the overall configuration of an ink jet recording apparatus (image forming apparatus) including a head cleaning device according to an embodiment of the present invention. An ink jet recording apparatus 10 shown in the same drawing is a two-liquid coagulation type recording apparatus that uses coagulation process liquid having a function of coagulating ink related to ink containing color materials, to form an image on the recording surface of a recording medium 14 based on predetermined image data.

The ink jet recording apparatus 10 includes, mainly, a paper feed unit 20, a process liquid application unit 30, a drawing unit 40, a drying unit 50, a fixing unit 60, and an ejection unit 70. In addition, although not shown in FIG. 1, an ink supply device that performs ink supply to the drawing unit 40 is provided.

As means for transferring the recording medium 14 transported the front stage of the process liquid application unit 30, the drawing unit 40, the drying unit 50, and the fixing unit 60, transfer cylinders 32, 42, 52, and 62 are provided. As means for holding and transporting the recording medium 14 to each of the process liquid application unit 30, the drawing unit 40, the drying unit 50, and the fixing unit 60, impression cylinders 34, 44, 54, and 64 having a drum shape are provided.

The transfer cylinders 32 to 62 and the impression cylinders 34 to 64 are provided with grippers 80A and 80B that hold the tip portion of the recording medium 14 in a predetermined position on the outer circumference surface with the tip portion interposed therebetween. A structure in which the tip portion of the recording medium 14 in the gripper 80A and the gripper 80B is held interposed therebetween, and a structure in which the recording medium 14 is transferred between the grippers included in other impression cylinders or transfer cylinders are the same as each other, and the gripper 80A and the gripper 80B are disposed in a position moved 180° symmetrical with respect to the rotational direction of the impression cylinder 34 on the outer circumference surface of the impression cylinder 34.

When the transfer cylinders 32 to 62 and the impression cylinders 34 to 64 are rotated in a predetermined direction in the state where the tip portion of the recording medium 14 is pinched by the grippers 80A and 80B, the recording medium 14 is rotationally transported along the outer circumference surfaces of the transfer cylinders 32 to 62 and the impression cylinders 34 to 64.

Meanwhile, in FIG. 1, only the grippers 80A and 80B included in the impression cylinder 34 are designated by the reference numerals, and the reference numerals of the grippers of other impression cylinders and transfer cylinders will be omitted.

When the recording medium (sheet of paper) 14 received in the paper feed unit 20 is fed to the process liquid application unit 30, coagulation process liquid (hereinafter, simply referred to as the "process liquid" in some cases) is supplied to the recording surface of the recording medium 14 held on the outer circumference surface of the impression cylinder 34. Meanwhile, the "recording surface of the recording medium 14" is a lateral surface in the state where the impression cylinders 34 to 64 are held, and is a surface opposite to the surface held in the impression cylinders 34 to 64.

Thereafter, the recording medium 14 to which the coagulation process liquid is supplied is sent out to the drawing unit 40, color ink is supplied to a region of the recording surface to which the coagulation process liquid is supplied in the drawing unit 40, and thus a desired image is formed.

Further, the recording medium 14 on which an image is formed by such color ink is sent to the drying unit 50, drying is performed in the drying unit 50, the image is sent to the fixing unit 60 after the drying, and fixing thereof is performed. The image formed on the recording medium 14 is ruggedized by performing the drying and the fixing. In this manner, a desired image is formed on the recording surface of the recording medium 14, such an image is fixed on the recording surface of the recording medium 14, and then the image is transported from the ejection unit 70 to the outside of the device.

Hereinafter, each of the units (the paper feed unit 20, the process liquid application unit 30, the drawing unit 40, the drying unit 50, the fixing unit 60, and the ejection unit 70) of the ink jet recording apparatus 10 will be described in detail.

(Paper Feed Unit)

The paper feed unit 20 is provided with a paper feed tray 22 and a sending-out mechanism which is not shown, and the recording medium 14 is configured to be sent out one by one from the paper feed tray 22. The recording medium 14 sent out from the paper feed tray 22 is positioned by a guiding member, which is not shown, so that the tip portion thereof is located at a position of the gripper (not shown) of the transfer cylinder (paper feed cylinder) 32, and is stopped temporarily.

(Process Liquid Application Unit)

The process liquid application unit 30 includes the process liquid cylinder (process liquid drum) 34 that holds the recording medium 14 transferred from the paper feed cylinder 32 on the outer circumference surface to transport the recording medium 14 in a predetermined transport direction, and the process liquid application unit 30 that supplies the process liquid on the recording surface of the recording medium 14 held on the outer circumference surface of the process liquid cylinder 34. When the process liquid cylinder 34 is rotated in the counterclockwise direction in FIG. 1, the recording medium 14 is rotationally transported in the counterclockwise direction along the outer circumference surface of the process liquid cylinder 34.

The process liquid application unit 30 shown in FIG. 1 is provided in a position opposed to the outer circumference surface (recording medium holding surface) of the process liquid cylinder 34. A configuration example of the process liquid application unit 30 includes an aspect which is configured to include a process liquid container in which the process liquid is reserved, a drawing-up roller, of which a portion is immersed in the process liquid of the process liquid container, that draws up the process liquid within the process liquid container, and an application roller (rubber roller) that moves the process liquid drawn up by the drawing-up roller onto the recording medium 14.

Meanwhile, an aspect is preferable which is configured to include an application roller movement mechanism that moves such an application roller in the vertical direction (normal direction of the outer circumference surface of the process liquid cylinder 34), and to be capable of avoiding a collision between such an application roller and the grippers 80A and 80B.

The process liquid supplied to the recording medium 14 by the process liquid application unit 30 contains a color material coagulant that coagulates color materials (pigments) in ink supplied in the drawing unit 40, and when the process liquid and the ink come into contact with each other on the recording medium 14, separation of color materials from a solvent in the ink is facilitated.

The process liquid application unit 30 preferably performs the application while measuring the amount of the process liquid applied to the recording medium 14, and the film thickness of the process liquid on the recording medium 14 is preferably sufficiently made smaller than the diameter of an ink droplet ejected from the drawing unit 40.

(Drawing Unit)

The drawing unit 40 includes the drawing cylinder (drawing drum) 44 that holds and transports the recording medium 14, a paper pressing roller 46 for closely attaching the recording medium 14 to the drawing cylinder 44, and ink jet heads 48M, 48K, 48C, and 48Y that supply ink to the recording medium 14. The drawing cylinder 44 is disposed so that the grippers 80A and 80B that pinch the tip portion of the recording medium 14 protrudes from the periphery thereof. In addition, the drawing cylinder 44 has a function for fixedly holding the recording medium 14 on the outer circumference surface thereof. Specific examples of the fixing function of the recording medium 14 include vacuum adsorption, electrostatic adsorption and the like.

The paper pressing roller 46 is a guiding member for closely attaching the recording medium 14 to the outer circumference surface of the drawing cylinder 44, is opposed to the outer circumference surface of the drawing cylinder 44, and is disposed further to the downstream side of the recording medium 14 in the transport direction from the delivery position of the recording medium 14 between the transfer cylinder 42 and the drawing cylinder 44, and further to the upstream side of the recording medium 14 in the transport direction from the ink jet heads 48M, 48K, 48C, and 48Y.

In addition, a paper floating detection sensor (not shown) is disposed between the paper pressing roller 46 and the ink jet head 48Y on the furthest upstream side of the recording medium 14 in the transport direction. Such a paper floating detection sensor detects the floating amount just before the recording medium 14 goes in immediately below the ink jet heads 48M, 48K, 48C, and 48Y. When the floating amount of the recording medium 14 detected by the paper floating detection sensor exceeds a predetermined threshold, the ink jet recording apparatus 10 shown in the present example is configured to notify that effect and to halt the transport of the recording medium 14.

When the recording medium 14 transferred from the transfer cylinder 42 to the drawing cylinder 44 is rotationally transported in the state where the tip thereof is held by the grippers (of which the reference numerals are omitted), the recording medium is pressed by the paper pressing roller 46 and is closely attached to the outer circumference surface of the drawing cylinder 44. In this manner, when the recording medium 14 is closely attached to the outer circumference surface of the drawing cylinder 44, the recording medium is sent to the printing area immediately below the ink jet heads 48M, 48K, 48C, and 48Y in the state where it does not float up from the outer circumference surface of the drawing cylinder 44.

The ink jet heads 48M, 48K, 48C, and 48Y that correspond to the four colors of ink magenta (M), black (K), cyan (C), yellow (Y), respectively, are disposed in order from the upstream side in the rotational direction (counterclockwise rotation direction in FIG. 1) of the drawing cylinder 44, and are disposed so that the ink ejection surfaces (nozzle surfaces) of the ink jet heads 48M, 48K, 48C, and 48Y are opposed to the recording surface of the recording medium 14 held on the drawing cylinder 44. Meanwhile, the term "ink ejection surfaces (nozzle surfaces)" are surfaces of the ink jet heads 48M, 48K, 48C, and 48Y opposed to the recording surface of the recording medium 14, and are surfaces on which nozzles (shown in FIG. 3 as reference numeral 108), from which ink is ejected described later, are formed.

In addition, the ink jet heads 48M, 48K, 48C, and 48Y shown in FIG. 1 are disposed to be inclined with respect to the horizontal plane so that the recording surface of the recording medium 14 held on the outer circumference surface of the drawing cylinder 44 and the nozzle surfaces of the ink jet heads 48M, 48K, 48C, and 48Y are approximately parallel to each other.

The ink jet heads 48M, 48K, 48C, and 48Y are full-line type heads having a length corresponding to the maximum width (length of the direction perpendicular to the transport direction of the recording medium 14) of the image forming region in the recording medium 14, and are fixedly installed so as to extend in the direction perpendicular to the transport direction of the recording medium 14. In addition, each of the ink jet heads 48M, 48K, 48C, and 48Y is supplied with ink from an ink supply device of which the details are described later.

In the nozzle surfaces (liquid ejection surfaces) of the ink jet heads 48M, 48K, 48C, and 48Y, ink injection nozzles are formed to be arranged in a matrix over the entire width of the image forming region of the recording medium 14.

When the recording medium 14 is transported to the printing area immediately below the ink jet heads 48M, 48K, 48C, and 48Y, ink of each color is ejected (dropped), based on image data, from the ink jet heads 48M, 48K, 48C, and 48Y to the region to which the coagulation process liquid of the recording medium 14 is supplied.

When droplets of corresponding color ink are ejected from the ink jet heads 48M, 48K, 48C, and 48Y toward the recording surface of the recording medium 14 held on the outer circumference surface of the drawing cylinder 44, the process liquid and the ink come into contact with each other on the recording medium 14, the coagulation reaction of color materials (pigment-based color materials) dispersed in ink or color materials (dye-based color materials) insolubilized therein is expressed, and a color material coagulated body is formed. Thereby, the movement (dot position deviation or dot color unevenness) of color materials in the images formed on the recording medium 14 is prevented.

In addition, since the drawing cylinder 44 of the drawing unit 40 is structurally separated from the process liquid cylinder 34 of the process liquid application unit 30, the process liquid is not attached to the ink jet heads 48M, 48K, 48C, and 48Y, thereby allowing the cause of abnormal ink ejection to be reduced.

Meanwhile, in the present example, the constitution of standard colors (four colors) of MKCY is exemplified, ink colors or a combination of the number of colors is not limited to the present embodiment, and light ink, dark ink, and specific color ink may be added as necessary. For example, the configuration is also possible in which an ink jet head that ejects light inks such as light cyan and light magenta are added, and the arrangement order of each color head is not also particularly limited.

(Drying Unit)

The drying unit 50 includes the drying cylinder (drying drum) 54 that holds and transports the recording medium 14 after the image formation, and a drying device 56 that performs a drying process of evaporating water (liquid component) on such a recording medium 14. Meanwhile, the basic structure of the drying cylinder 54 is in common with the process liquid cylinder 34 and the drawing cylinder 44 described previously, and thus a description herein will be omitted.

The drying device 56 is a processing unit, disposed at a position opposite to the outer circumference surface of the drying cylinder 54, that evaporates water existing in the recording medium 14. When ink is supplied to the recording medium 14 by the drawing unit 40, a liquid component (solvent component) of the ink and a liquid component (solvent component) of the process liquid which are separated by the coagulation reaction of the process liquid with the ink remain on the recording medium 14, and thus it is necessary to remove such a liquid component.

The drying device 56 is a processing unit that performs a drying process of evaporating the liquid component existing on the recording medium 14 through heating by a heater, blowing by a fan, or with a combination thereof, and removes the liquid component on the recording medium 14. The heating amount and the blowing amount supplied to the recording medium 14 are appropriately set in accordance with parameters such as the water amount remaining on the recording medium 14, the type of the recording medium 14, and the transport speed (drying time) of the recording medium 14.

When the drying is performed by the drying device 56, the drying cylinder 54 of the drying unit 50 is structurally separated from the drawing cylinder 44 of the drawing unit 40. Therefore, in the ink jet heads 48M, 48K, 48C, and 48Y, the cause of the abnormal ink ejection due to the drying of a head meniscus portion through heating or blowing can be reduced.

In order to exhibit a correction effect of cockling of the recording medium 14, the curvature of the drying cylinder 54 may be set to 0.002 (1/mm) or more. In addition, in order to prevent a curve (curl) of the recording medium after the drying, the curvature of the drying cylinder 54 may be set to 0.0033 (1/mm) or less.

In addition, means (for example, a built-in heater) that adjusts the surface temperature of the drying cylinder 54 may be included, and such a surface temperature may be adjusted to a temperature of 50° C. or higher. The drying is facilitated by performing heating treatment from the back side of the recording medium 14, and image destruction in a fixing process of the next step is prevented. In such an aspect, it is further effective to include means that closely attaches the recording medium 14 to the outer circumference surface of the drying cylinder 54. Examples of the means that closely attaches the recording medium 14 include vacuum adsorption, electrostatic adsorption and the like.

Meanwhile, although the upper limit of the surface temperature of the drying cylinder 54 is not particularly limited, it is preferable to set to a temperature of 75° C. or lower (more preferably, 60° C. or lower) from the viewpoint of the safety (prevention of burning due to high temperatures) of maintenance working such as cleaning and the like of ink attached to the surface of the drying cylinder 54.

The recording surface of the recording medium 14 is held on the outer circumference surface of the drying cylinder 54 configured in this manner so as to face outward (that is, in the state where the recording surface of the recording medium 14 is curved so as to become the convex side), and the drying is performed while it is rotationally transported, so that drying unevenness caused by wrinkles or floating of the recording medium 14 is reliably prevented.

(Fixing Unit)

The fixing unit 60 includes the fixing cylinder (fixing drum) 64 that holds and transports the recording medium 14, a heater 66 that performs heating treatment on the recording medium 14 on which the image is formed and liquid is removed, and a fixing roller 68 that presses such a recording medium 14 from the recording surface side. Meanwhile, the basic structure of the fixing cylinder 64 is in common with the process liquid cylinder 34, the drawing cylinder 44, and the drying cylinder 54, and thus a description herein will be omitted. The heater 66 and the fixing roller 68 are disposed at a position opposite to the outer circumference surface of the fixing cylinder 64, and are disposed in order from the upstream side of the fixing cylinder 64 in the rotational direction (counterclockwise rotation direction in FIG. 1).

In the fixing unit 60, preheating treatment is performed on the recording surface of the recording medium 14 by the heater 66, and the fixing is performed by the fixing roller 68. The heating temperature of the heater 66 is appropriately set in accordance with the type of the recording medium, the type of ink (type of a polymer particles contained in ink) and the like. For example, an aspect is considered in which the glass transition point temperature or the minimum film formation temperature of the polymer particles contained in ink is set.

The fixing roller 68 is a roller member for melting self-dispersive polymer particles in ink by heating and pressurizing the dried ink and for causing ink to be a coating film, and is configured to heat and pressurize the recording medium 14. Specifically, the fixing roller 68 is disposed so as to be pressure-bonded to the fixing cylinder 64, and is configured to form a nip roller between the fixing cylinder 64 and the fixing roller. Thereby, the recording medium 14 is interposed between the fixing roller 68 and the fixing cylinder 64 and is nipped by a predetermined nip pressure, whereby the fixing is performed.

A configuration example of the fixing roller 68 includes an aspect constituted by a heating roller in which a halogen lamp is embedded in a metal pipe such as aluminum having a good thermal conductivity. When heat energy having a glass transition point temperature or higher of the polymer particles contained in ink are supplied by heating the recording medium 14 using such a heating roller, the polymer particles are melted and thus a transparent coating film is formed on the surface of the image.

The pressure is applied to the recording surface of the recording medium 14 in this state, the melted polymer particles are pushed and fixed onto the irregularities of the recording medium 14, and the irregularities on the surface of the image are leveled, thereby allowing preferable glossiness to be obtained. Meanwhile, the configuration is also preferable in which the fixing rollers 68 is provided in multiple stages in accordance with the thickness of the image layer or the characteristics of the glass transition point temperature of the polymer particles.

In addition, the surface hardness of the fixing roller 68 is preferably 71° or lower. The surface of the fixing roller 68 is made softer, whereby the following effect can be expected with respect to the irregularities of the recording medium 14 generated by the cockling, and the fixing unevenness caused by the irregularities of the recording medium 14 can be effectively prevented.

In the ink jet recording apparatus 10 shown in FIG. 1, an inline sensor 82 is provided in a subsequent stage of the processing region of the fixing unit 60 (downstream side of the recording medium in the transport direction). The inline sensor 82 is a sensor for reading out an image (or a check pattern formed in a blank region of the recording medium 14) formed on the recording medium 14, and a CCD line sensor is suitably used.

In the ink jet recording apparatus 10 shown in the present example, the presence or absence of the abnormal ejection of the ink jet heads 48M, 48K, 48C, and 48Y is determined based on the readout results of the inline sensor 82. In addition, in the inline sensor 82, an aspect including measurement unit for measuring the water amount, the surface temperature, the glossiness and the like can also be used. In such an aspect, parameters such as the processing temperature of the drying unit 50 or the heating temperature and the pressurizing pressure of the fixing unit 60 are appropriately adjusted based on the readout results of the water amount, the surface temperature, and the glossiness, the above-mentioned control parameters are appropriately adjusted corresponding to the temperature change of the inside of the device or the temperature change of each unit.

(Ejection Unit)

As shown in FIG. 1, the ejection unit 70 is provided subsequently to the fixing unit 60. The ejection unit 70 includes an endless transport chain 74 wound around stretching rollers 72A and 72B, and a discharge tray 76 in which the recording medium 14 after the image formation is received.

The recording medium 14 after the fixing which is sent out from the fixing unit 60 is transported by the transport chain 74 and is discharged to the discharge tray 76.

(Maintenance Unit)

Figure 4:
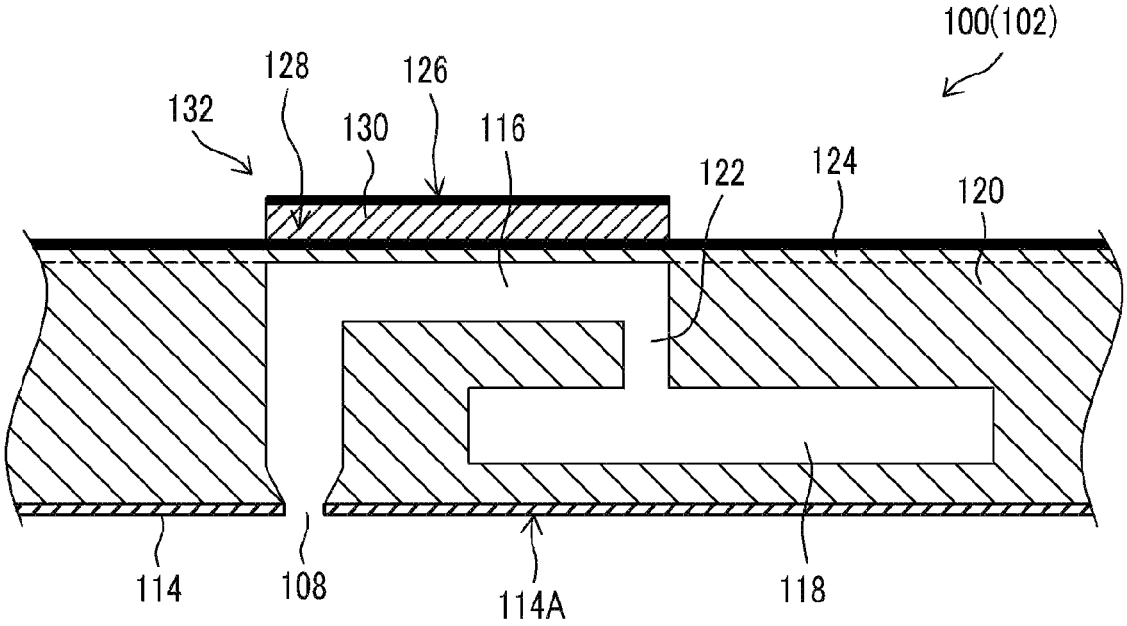
FIG. 4 is a cross-sectional view illustrating a three-dimensional structure of the ink jet head shown in FIG. 2.

The ink jet recording apparatus 10 shown in FIG. 1 is equipped with a maintenance unit (shown in FIG. 5 as reference numeral 188), although not shown in the same drawing, including a head cleaning unit (shown in FIG. 6 as reference numeral 200) for cleaning the nozzle surfaces (which are not shown in FIG. 1, and are shown in FIG. 4 as reference numeral 114A) of the ink jet heads 48M, 48K, 48C, and 48Y. The maintenance unit is arranged immediately lateral to the drawing cylinder 44, adjacent to the direction perpendicular to the transport direction of the recording medium 14 of the drawing unit 40 (drawing cylinder 44) (see FIG. 6). When the maintenance process is executed, the ink jet heads 48M, 48K, 48C, and 48Y are moved from just above the drawing cylinder 44 to the processing region of the maintenance unit. Meanwhile, the details of the maintenance unit will be described later.

[Structure of Ink Jet Head]

Next, an example of the structures of the ink jet heads 48M, 48K, 48C, and 48Y included in the drawing unit 40 will be described. Meanwhile, since the structures of the ink jet heads 48M, 48K, 48C, and 48Y corresponding to each color are in common with each other, hereinafter, the ink jet head (hereinafter, simply referred to as the "head") is denoted by reference numeral 100 as representing them.

Figure 2:
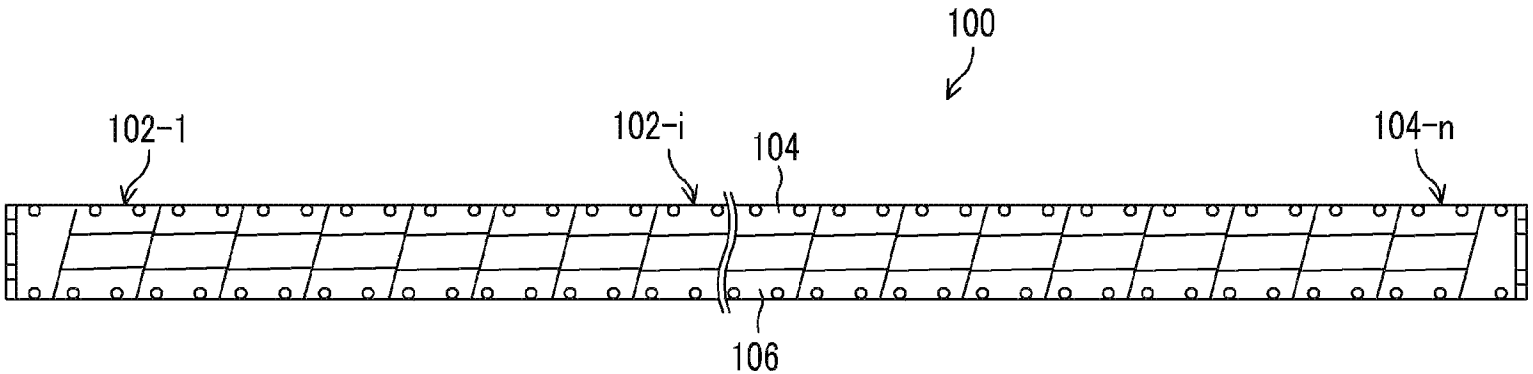
FIG. 2 is a perspective plan view illustrating a structural example of a full-line type head applied to the ink jet recording apparatus shown in FIG. 1.

FIG. 2 is a schematic configuration diagram of an ink jet head 100, and is a diagram (perspective plan view of the head) when the recording surface of the recording medium is viewed from the ink jet head 100. The head 100 in the same drawing forms a multi-head by piecing together n head modules 102-*i* (i is an integer of 1 to n) in a line along the longitudinal direction of the head 100. In addition, each of the head modules 102-*i* is supported from both sides of the head 100 in the lateral direction by head covers 104 and 106. Meanwhile, the multi-head can also be formed by arranging the head module 102 in a zigzag.

An application example of the multi-head formed of a plurality of sub-heads includes a full-line type head corresponding to the entire width of the recording medium. The full-line type head has a structure in which a plurality of nozzles (shown in FIG. 3 as reference numeral 108) is arranged corresponding to the length (width) in the main scanning direction of the recording medium, with respect to the direction (main scanning direction) perpendicular to the movement direction (sub-scanning direction) of the recording medium. An image can be formed over the entire surface of the recording medium by a so-called single-path image recording method of performing image recording by relatively scanning the head 100 having such a structure and the recording medium one time.

The head modules 102-*i* constituting the head 100 has a planar shape with an approximate parallelogram, and is provided with an overlap portion between adjacent sub-heads. The overlap portion is a link portion of the sub-heads, and is formed by the nozzles belonging to the sub-heads having different adjacent dots with respect to the arrangement direction of the head modules 102-*i*.

Figure 3:
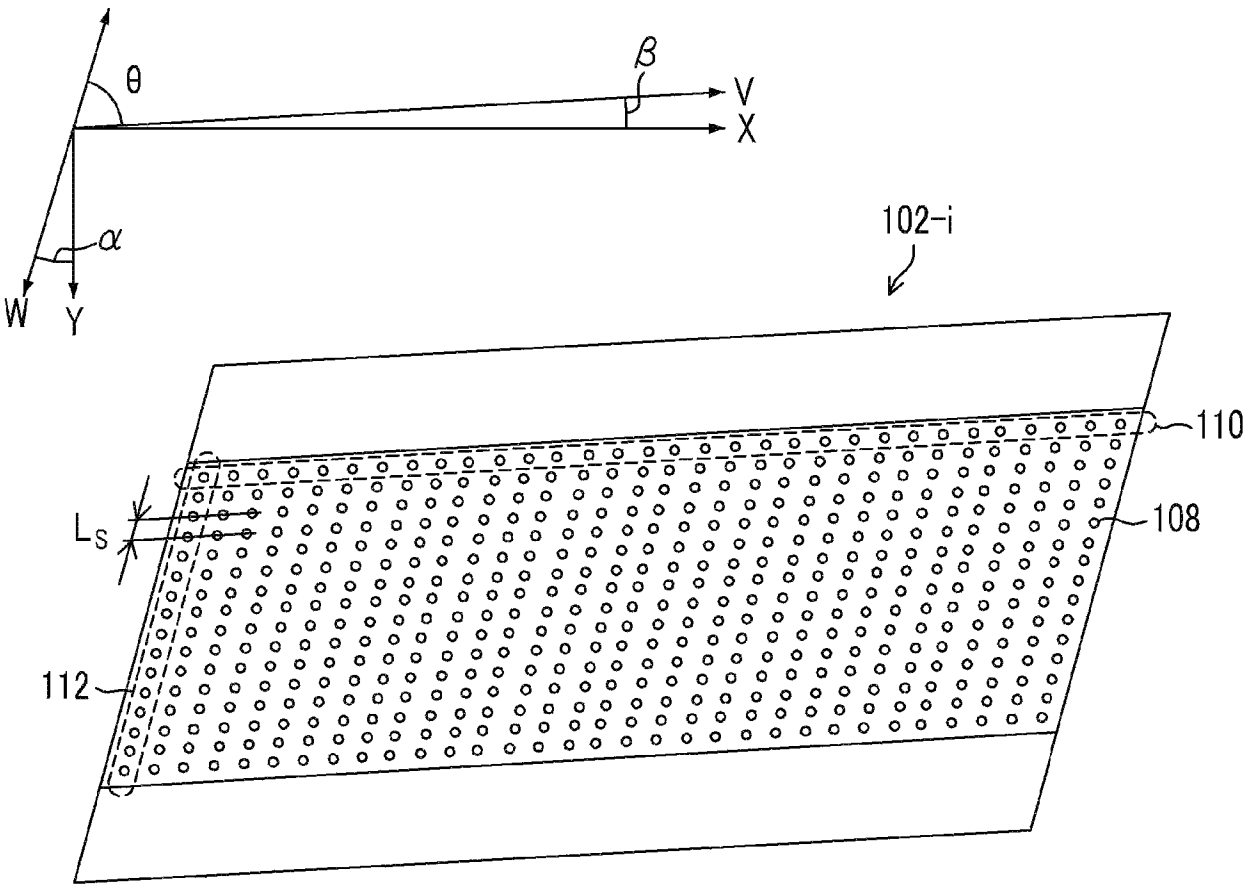
FIG. 3 is a perspective plan view for explaining the nozzle arrangement of an ink jet head shown in FIG. 2.

FIG. 3 is a perspective plan view illustrating the nozzle arrangement of the head modules 102-*i*. As shown in the same drawing, each of the head modules 102-*i* has a structure in which the nozzles 108 are arranged in a two-dimensional shape, and the head including such head modules 102-*i* is referred to as a so-called matrix head. The head module 102-*i* shown in FIG. 3 has a structure in which a large number of nozzles 108 is arranged along the column direction W at the angle $\alpha$ to the sub-scanning direction Y, and the row direction V at the angle $\beta$ to the main scanning direction X, and the substantial nozzle arrangement density in the main scanning direction X is highly densified. In FIG. 3, a nozzle group (nozzle row) arranged along the row direction V is shown as reference numeral 110, and a nozzle group (nozzle column) arranged along the column direction W is shown as reference numeral 112.

Meanwhile, another example of the matrix arrangement of the nozzles 108 includes a configuration in which a plurality of nozzles 108 is arranged along the row direction in the main scanning direction X, and the column direction oblique to the main scanning direction X.

FIG. 4 is a cross-sectional view illustrating a three-dimensional configuration of a droplet ejection element (ink chamber unit corresponding to one nozzle 108) of one channel serving as a recording element unit. As shown in the same drawing, the head 100 of the present example has a structure in which the nozzle plate 114 where the nozzles 108 are formed and a flow channel plate 120 where flow channels such as a pressure chamber 116 or a common flow channel 118 are formed are stacked and joined with each other. The nozzle plate 114 constitutes the nozzle surface 114A of the head 100, and a plurality of nozzles 108 respectively communicating with each pressure chamber 116 is formed two-dimensionally.

The flow channel plate 120 is a flow channel forming member that forms a supply port 122 as the contraction portion (narrowest portion) of an individual supply path which constitutes the sidewall portion of the pressure chamber 116 and guides ink from the common flow channel 118 to the pressure chamber 116. Meanwhile, although simply shown in FIG. 4 for convenience of the description, the flow channel plate 120 is a structure in which one or a plurality of substrates is laminated.

The nozzle plate 114 and the flow channel plate 120 can be processed in a required shape by a semiconductor manufacturing process using silicon as a material.

The common flow channel 118 communicates with an ink tank (not shown) which is an ink supply source, and ink supplied from the ink tank is supplied to each pressure chamber 116 through the common flow channel 118.

A piezo actuator 132 including an individual electrode 126 and a lower electrode 128 and having a structure in which a piezoelectric body 130 is interposed between the individual electrode 126 and the lower electrode 128 is joined to a vibration plate 124 forming a portion of the surface (top surface in FIG. 4) of the pressure chamber 116. When the vibration plate 124 is formed of a metal thin film or a metal oxide film, the vibration plate functions as a common electrode equivalent to the lower electrode 128 of the piezo actuator 132. Meanwhile, in an aspect in which the vibration plate is formed by a nonconductive material such as resin, a lower electrode layer is formed on the surface of a vibration plate member by a conductive material such as a metal.

The piezo actuator 132 is deformed by applying a drive voltage to the individual electrode 126 to thereby change the volumetric capacity of the pressure chamber 116, and ink is ejected from the nozzles 108 by the accompanying pressure change. When the piezo actuator 132 is restored to its original state after the ink ejection, the pressure chamber 116 is refilled with new ink from the common flow channel 118 through the supply port 122.

The high-density nozzle head of the present example is realized, as shown in FIG. 3, by arranging a lot of ink chamber units having such a structure in a constant array pattern in a lattice shape, along the row direction V at the angle β to the main scanning direction X and the column direction W at the angle α to the sub-scanning direction Y. In such a matrix array, when the gap of the adjacent nozzles in the sub-scanning direction Y is set to $L_s$, the main scanning direction X can be handled equivalently to a state in which each of the nozzles 108 is substantially linearly arranged with a constant pitch of $P=L_s/\tan\theta$.

In the present example, although the piezo actuator 132 is applied as ejection force generation unit of ink ejected from the nozzles 108 provided in the head 100, a thermal system can also be applied that includes a heater within the pressure chamber 116 and ejects ink using the pressure of film boiling through heating of the heater.

[Description of Control System]

Figure 5:
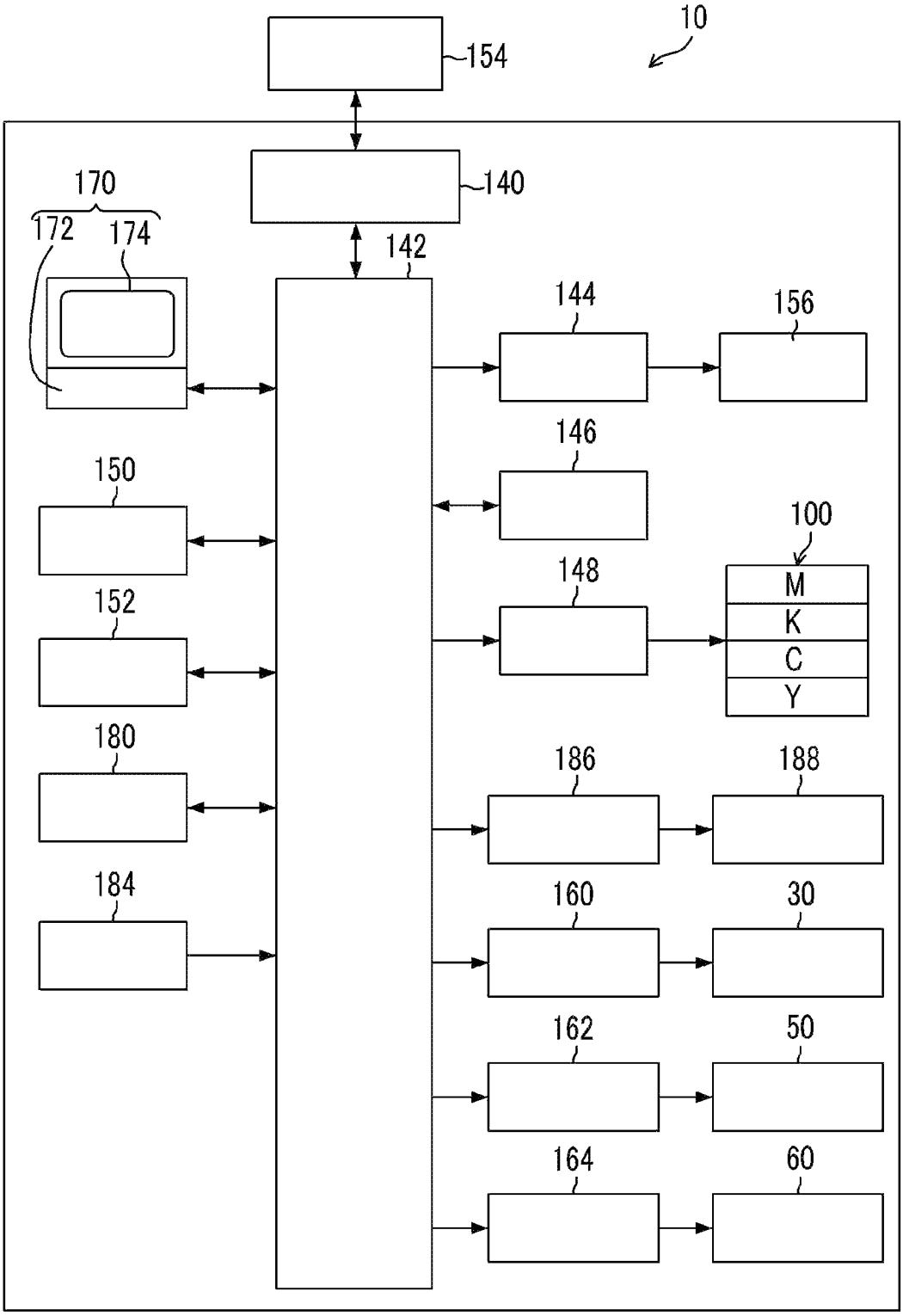
FIG. 5 is a main block diagram illustrating a system configuration of the ink jet recording apparatus shown in FIG. 1.

FIG. 5 is a block diagram illustrating a schematic configuration of a control system of the ink jet recording apparatus 10. The ink jet recording apparatus 10 includes a communication interface 140, a system control unit 142, a transport control unit 144, an image processing unit 146, and a head drive unit 148, and includes an image memory 150 and a ROM 152.

The communication interface 140 is an interface unit that receives image data sent from a host computer 154. The communication interface 140 may apply a serial interface such as USB (Universal Serial Bus), and may apply a parallel interface such as a Centronics connector. The communication interface 140 may mount a buffer memory (not shown) for speeding up the communication.

The system control unit 142 is constituted by a central processing unit (CPU), peripheral circuits thereof and the like, and functions as a control unit that controls the entire ink jet recording apparatus 10 in accordance with a predetermined program, functions as an arithmetic unit that performs various types of arithmetic operations, and further functions as a memory controller of the image memory 150 and the ROM 152. That is, the system control unit 142 controls each of the units such as the communication interface 140 and the transport control unit 144, performs the communication control with the host computer 154 and the reading and writing control or the like of the image memory 150 and the ROM 152, and generates control signals that control each of the units mentioned above.

The image data sent out from the host computer 154 is incorporated into the ink jet recording apparatus 10 through the communication interface 140, and predetermined image processing is performed by the image processing unit 146.

The image processing unit 146 is a control unit that has a signal (image) processing function of performing various types of processing for generating a print control signal from the image data and processing such as correction, and supplies the generated print data to the head drive unit 148. Necessary signal processing is performed in the image processing unit 146, and the control of the amount of droplets ejected (the amount of droplets dropped) of the head 100 or the ejection timing is performed through the head drive unit 148, based on such image data. Thereby, the desired dot size or dot arrangement is realized. Meanwhile, a feedback control system for constantly maintaining the drive conditions of the head 100 may be included in the head drive unit 148 shown in FIG. 5.

The head drive unit 148 includes a drive waveform generation unit that generates a drive waveform, an amplification unit that amplifies such a drive waveform to generate a drive voltage, and a drive voltage supply unit that supplies a drive voltage having a predetermined drive waveform to the head. A drive waveform is generated based on image data (digital data) sent from the system control unit (or, a corresponding drive waveform is selected from drive waveforms previously stored), and a drive voltage having such a drive waveform is generated.

The transport control unit 144 controls the transport timing and the transport speed of the recording medium 14 (see FIG. 1) based on the print control signal generated by the image processing unit 146. The transport drive unit 156 in FIG. 5 is equipped with motors for rotating the impression cylinders 34 to 64 of FIG. 1, motors for rotating the transfer cylinders 32 to 62, a motor of the transport mechanism of the recording medium 14 in the paper feed unit 20, a motor for driving the stretching roller 72A (72B) of the ejection unit 70, and the like, and the transport control unit 144 functions as a driver of the above-mentioned motors. In addition, although not shown, a fixing control unit that controls the fixing of the recording medium 14 in the drawing cylinder 44 (see FIG. 1) is provided corresponding to the transport control of the recording medium 14. For example, an aspect in which the recording medium 14 is fixed by the vacuum adsorption includes a pump control unit that controls the operation of a vacuum pump, and a valve control unit that controls the operation of a valve for switching the opening and closing of a vacuum flow channel.

The image memory (primary storage memory) 150 has a function as primary storage unit that once stores image data input through the communication interface 140, or a function as a development area of various types of programs stored in the ROM 152 and an operational working area of CPU (for example, working area of the image processing unit 146). A volatile memory (RAM) in which sequential reading and writing can be performed is used in the image memory 150.

In the ROM 152, programs executed by the CPU of the system control unit 142, various types of data necessary to control each unit of the devices, control parameters, and the like are stored, and reading and writing of data are performed through the system control unit 142. The ROM 152 is not limited to a memory made of semiconductor elements, and a magnetic medium such as a hard disk may be used therein. In addition, an external interface may be included in the ROM, and a removable storage medium may be used therein.

Further, the ink jet recording apparatus 10 includes a process liquid supply control unit 160, a drying control unit 162, and a fixing control unit 164, and controls the operations of each unit of the process liquid application unit 30, the drying unit 50, and the fixing unit 60, respectively, according to the instructions from the system control unit 142.

The process liquid supply control unit 160 controls the timing of the process liquid supply of the process liquid application unit 30 and controls the supply amount of the process liquid, based on print data obtained from the image processing unit 146. In addition, the drying control unit 162 controls the timing of the drying in the drying device 56 (see FIG. 1) included in the drying unit 50 and controls the processing temperature, the blowing amount and the like, and the fixing control unit 164 controls the temperature of the heater 66 (see FIG. 1) included in the fixing unit 60 and controls the pressing of the fixing roller 68 (see FIG. 1).

An inline detection unit 166 including the inline sensor 82 shown in FIG. 1 is a processing block including a signal processing unit that performs predetermined signal processing such as nozzle removal or amplification, and waveform shaping on the readout signal which is output from the inline sensor 82. The system control unit 142 determines the presence or absence of the abnormal ejection of the head 100, based on the detection signal obtained by such an inline detection unit.

The ink jet recording apparatus 10 shown in the present example is provided with a user interface 170, and the user interface 170 includes an input device 172 for performing various types of inputs by an operator (user), and a display unit (display) 174. Various types of forms such as a keyboard, a mouse, a touch panel, and buttons can be adopted in the input device 172. The operator can perform input of the printing conditions, selection of the image quality modes, input and editing of accessory information, information searches, and the like by operating the input device 172, and various types of information items such as the input contents or the search results can be confirmed through the display of the display unit 174. The display unit 174 also functions as means for displaying warning such as an error message.

In a parameter storage unit 180, various types of control parameters necessary for the operation of the ink jet recording apparatus 10 are stored. The system control unit 142 appropriately reads out parameters necessary for the control, and executes updating (rewriting) various types of parameters as necessary.

A program storage unit 184 is storage unit in which control programs for activating the ink jet recording apparatus 10 are stored. The system control unit 142 (or each unit of the device) reads out a necessary control program from the program storage unit 184 at the time of executing the control of each unit of the device, and appropriately executes such a control program.

A maintenance control unit 186 is a control block that controls the operation of the maintenance unit 188, based on a command signal sent from the system control unit 142. When the control of the ink jet recording apparatus 10 transitions to a maintenance mode, the head 100 is moved from a print position just above the drawing cylinder 44 to a maintenance position, and each unit of the maintenance unit 188 is activated in response to the movement of the head 100.

[Detailed Description of Maintenance Unit]

Next, the maintenance unit 188 shown in FIG. 5 will be described in more detail.

(Overall Configuration)

Figure 6:
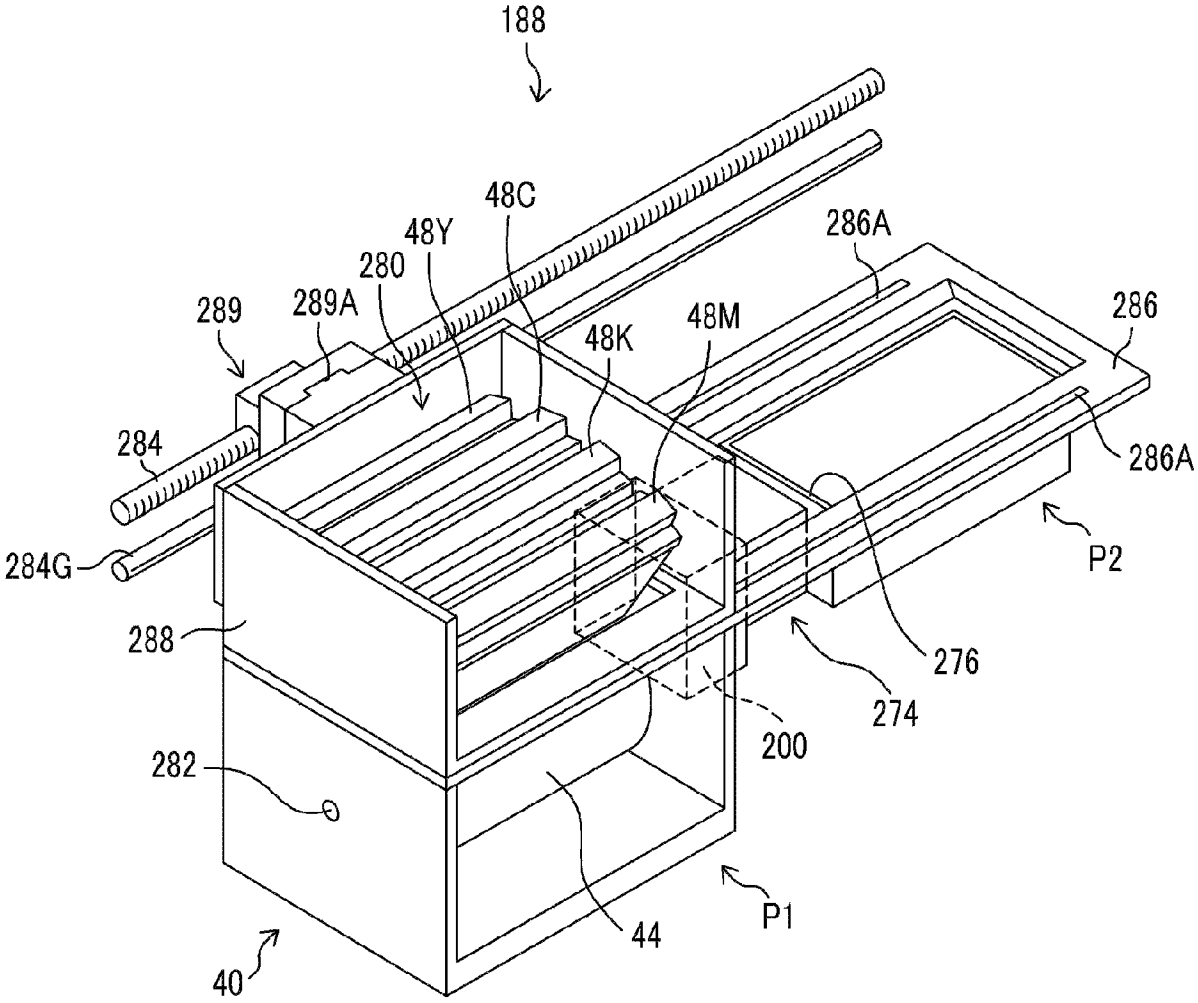
FIG. 6 is an overall configuration diagram of a maintenance unit applied to the ink jet recording apparatus shown in FIG. 1.

FIG. 6 is a perspective view illustrating the drawing unit 40 and the maintenance unit 188 provided adjacent to the drawing unit 40. As shown in the same drawing, the maintenance unit 188 is provided adjacent to the outside of the drawing cylinder 44 in the axial direction. The maintenance unit 188 is provided with the head cleaning unit 200 that supplies the cleaning liquid to the nozzle surface 114A (see FIG. 4) of the ink jet heads 48M, 48K, 48C, and 48Y, a wiping unit 274 that wipes out the nozzle surface 114A using a wiping member such as a blade, and a nozzle cap 276 used at the time of performing purge (preliminary ejection) and suction of the nozzles 108 (see FIG. 4), and the head cleaning unit 200 (shown by a dashed line), the wiping unit 274 (of which a portion is shown by a dashed line), and the nozzle cap 276 are disposed in a line in order from the side close to the drawing unit 40.

A head unit 280 in which the ink jet heads 48M, 48K, 48C, and 48Y corresponding to each color are mounted is attached to a ball screw 284 disposed parallel to a rotary shaft 282 of the drawing cylinder 44. In the lower side of the ball screw 284, a guide shaft 284G is disposed parallel to the ball screw 284, and the head unit 280 is slidably engaged with the guide shaft 284G. In addition, in the lower side of the head unit 280, a guide rail member 286 having a guide groove 286A that guides the movement of the head unit 280 is arranged parallel to the ball screw 284.

In the lower surface of a casing 288 of the head unit 280 that integrally holds the ink jet heads 48M, 48K, 48C, and 48Y, an engagement portion (not shown) engaged with the guide groove 286A protrudes, and the head unit 280 is movably guided to the guide groove 286A by the structure in which the engagement portion is slidably engaged with the guide groove 286A.

As shown in FIG. 6, the ball screw 284, the guide shaft 284G, the guide rail member 286 are extended along the axial direction of the drawing cylinder 44 with a necessary length so as to be capable of moving the head unit 280 from the image forming position (printing position or the drawing position) P1 above the drawing cylinder 44 to the position (capping position) P2 opposed to the nozzle cap 276. Meanwhile, the "maintenance position" in the ink jet recording apparatus 10 shown in the present example includes a region from the processing position (cleaning position) of the head cleaning unit 200 to the capping position P2.

The ball screw 284 is rotated by drive unit (for example, a motor) which is not shown, and the head unit 280 moves between the image forming position P1 and the maintenance position P2 by this rotation. In addition, the head unit 280 can move in the direction distant from the drawing cylinder 44 or the direction close to the drawing cylinder 44 by a vertical movement mechanism which is not shown.

The height of the head unit 280 (clearance between the recording surface of the recording medium 14 and each of the ink jet heads 48M, 48K, 48C, and 48Y) with respect to the surface of the drawing cylinder 44 is controlled according to the thickness of the recording medium 14 to be used. In addition, when a jam and the like occur at the time of the paper transport, the head unit 280 is moved in the upward direction of FIG. 6, thereby allowing the head unit to be evacuated from a predetermined height position at the time of the image formation.

Meanwhile, as shown in FIG. 6, in a connection portion 289 of the casing 288 of the head unit 280 with the ball screw 284 and the guide shaft 284G, a direct operable engagement structure 289A for guiding the movement of the head unit 280 in the vertical direction is adopted.

In the maintenance process performed by the maintenance unit 188 having such a structure, the cleaning liquid is supplied to the nozzle surface (see FIG. 4) of the head 100 in the head cleaning unit 200, the wiping is performed on the nozzle surface 114A in the wiping unit 274, and the ink ejection through the nozzles such as a purge or suction is performed in the nozzle cap 276.

(Head Cleaning Unit)

Next, the head cleaning unit 200 will be described. Meanwhile, in the following description, the ink jet heads 48M, 48K, 48C, and 48Y shown in FIG. 6 are referred to as the "head 100" collectively.

Figure 7:
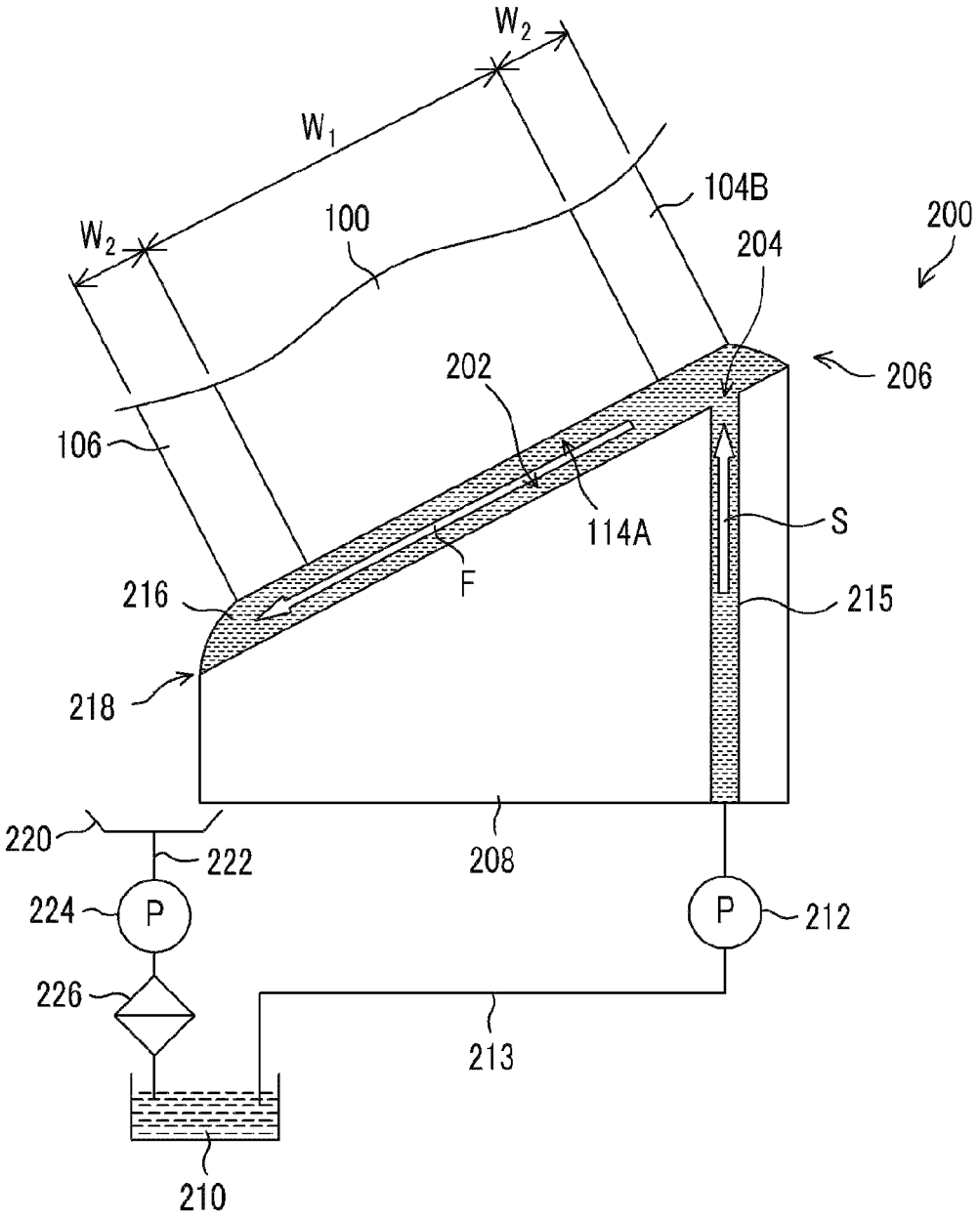
FIG. 7 is an explanatory diagram schematically illustrating a structure of a head cleaning unit shown in FIG. 6.

FIG. 7 is an explanatory diagram schematically illustrating an outline structure of the head cleaning unit 200. Meanwhile, the same drawing is a diagram viewed from the width direction (sub-scanning direction) of the full-line type head 100, and the direction passing through paper in the same drawing is the longitudinal direction (main scanning direction perpendicular to the transport direction of the recording medium) of the head 100. The head cleaning unit 200 shown in FIG. 7 performs the cleaning liquid supply process with respect to one head 100 one time.

The head cleaning unit 200 shown in FIG. 7 has a cleaning liquid holding surface 202 on which the cleaning liquid applied to the nozzle surface 114A of the head 100 is held, and includes a cleaning liquid application unit 208 in which a cleaning liquid supply nozzle 204 that supplies the cleaning liquid to the cleaning liquid holding surface 202 is provided in the vicinity of the upper side end 206 of the inclination of the cleaning liquid holding surface 202, a cleaning liquid tank 210 that reserves the cleaning liquid supplied to a cleaning liquid unit, and a supply pump 212 that controls the supply amount (supply amount of the cleaning liquid per unit time) of the cleaning liquid to the cleaning liquid holding surface 202.

When the supply pump 212 is activated in the pressure direction at a predetermined rotational speed, the cleaning liquid is sent from the cleaning liquid tank 210 through a supply flow channel 213 and a flow channel 215 within the cleaning liquid application unit 208 to the cleaning liquid supply nozzle 204 (the direction of liquid sending within the cleaning liquid application unit 208 is shown in FIG. 7 as sign S), and a certain amount of the cleaning liquid is supplied from the cleaning liquid supply nozzle 204 to the cleaning liquid holding surface 202. A small amount of cleaning liquid 214 flowing in from the cleaning liquid supply nozzle 204 wets and spreads between the nozzle surface 114A of the head 100 and the cleaning liquid holding surface 202 using liquid repellency of the nozzle surface 114A, and slides down the inclined cleaning liquid holding surface 202 while a meniscus (coating layer) 216 is formed between the nozzle surface 114A and the cleaning liquid holding surface 202. The white arrow shown in FIG. 7 as sign F indicates the movement direction (direction from the top right to the bottom left in FIG. 7) of the coating layer 216 of the cleaning liquid.

The cleaning liquid sliding down the inclined cleaning liquid holding surface 202 drops to a recovery tray 220 provided at the outside of the lower side end 218 of the inclination of the cleaning liquid holding surface 202. The recovery tray 220 communicates with the cleaning liquid tank 210 through a recovery flow channel 222. When a recovery pump 224 provided in the recovery flow channel 222 is activated, the used cleaning liquid, collected in the recovery tray 220, of which foreign substances are removed by a filter 226 provided in the recovery flow channel 222 is sent to the cleaning liquid tank 210 and is reused.

The cleaning liquid preferably has a function of dissolving ink attached to the nozzle surface 114A, or a function of peeling off solidified ink from the nozzle surface 114A. For example, water (pure water) can be applied as the cleaning liquid. In addition, an aqueous solution obtained by dissolving a predetermined solute component in a solvent such as water may be applied.

The length from the cleaning liquid supply nozzle 204 to the lower side end 218 of the inclination of the cleaning liquid holding surface 202 preferably exceeds the length $W_1$ in the longitudinal direction (inclination direction) of the head 100 of the nozzle arrangement region in which at least the nozzle of the head 100 (nozzle surface 114A) is arranged, and more preferably exceeds the length ($W_1+W_2\times2$) obtained by adding the length $W_2$ of the head covers 104 and 106 on both sides.

Although an aspect in which the cleaning liquid supply nozzle 204 is includes in the upper side end 206 of the inclination of the cleaning liquid holding surface 202 is exemplified in FIG. 7, the cleaning liquid supply nozzle 204 is preferably located at the upper side of the inclination from the nozzle arrangement region in which the nozzles 108 (see FIG. 4) are provided. In addition, at least one cleaning liquid supply nozzle 204 is preferably provided in the longitudinal direction of the head 100, but an aspect in which a plurality of cleaning liquid supply nozzles 204 is included in the longitudinal direction of the head 100 can also be applied.

In order for the cleaning liquid to slide down the inclined surface while a meniscus is formed between the nozzle surface 114A and the cleaning liquid holding surface 202, it is necessary to appropriately optimize parameters such as the surface nature (contact angle, surface roughness and the like) of the nozzle surface, the surface nature (contact angle, surface roughness and the like of the cleaning liquid holding surface, the physical properties (viscosity and the like) of the cleaning liquid, the average flow velocity (supply amount per unit time) of the cleaning liquid, and the shape and size of the cleaning liquid supply port. Hereinafter, the arrangement of the cleaning liquid supply nozzle 204 will be described in detail.

(Description of Cleaning Liquid Supply Nozzle)

Figure 8:
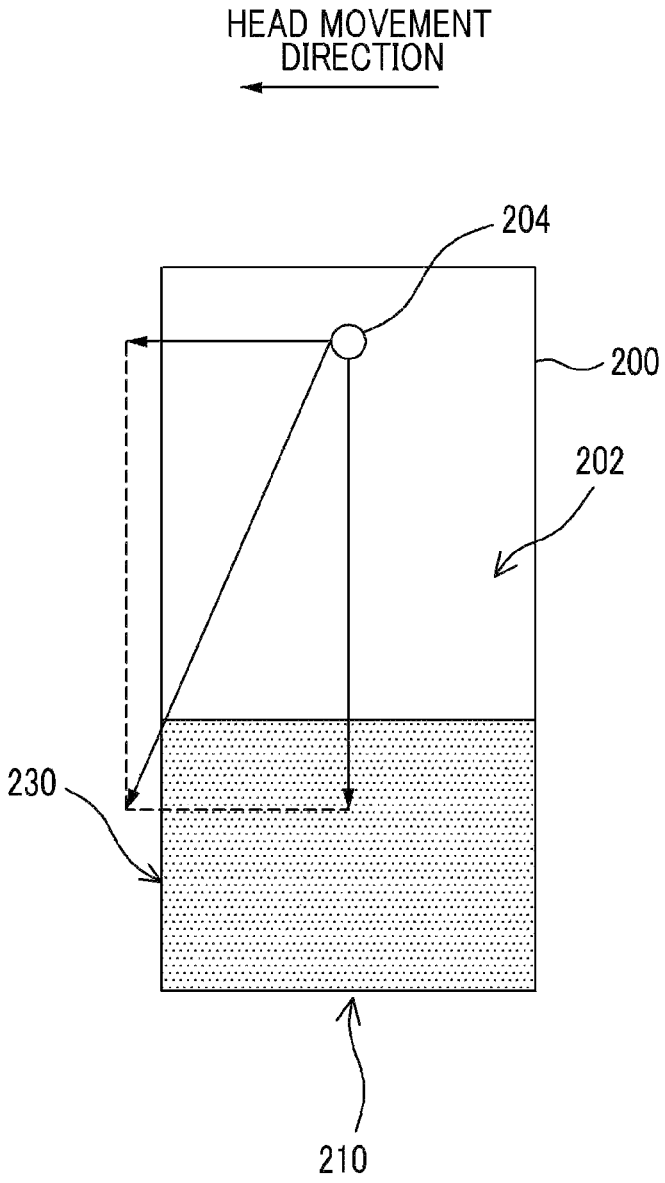
FIG. 8 is a diagram for explaining the arrangement of a cleaning liquid nozzle shown in FIG. 6.

FIG. 8 is an explanatory diagram schematically illustrating the arrangement of the cleaning liquid supply nozzle 204, and is a diagram when the cleaning liquid holding surface 202 is viewed from the head side (the upper side) which is not shown. In the state where the head 100 (see FIG. 7) stops, the entire cleaning liquid supplied from the cleaning liquid supply nozzle 204 flows down to the lower side end 218 of the inclination of the cleaning liquid supply nozzle 204, and thus the coating layer (liquid film) 216 (see FIG. 7) can be easily generated by the cleaning liquid in the entire inclination direction of the head 100 (nozzle surface 114A). Meanwhile, the downward arrow shown in FIG. 8 indicates the flow direction of the cleaning liquid.

On the other hand, for the purpose of shortening of the maintenance time, when the cleaning liquid is supplied to the nozzle surface 114A in the state where the head is moved, the force flowing in the movement direction (shown by a left-pointing arrow) of the head is generated. Therefore, the cleaning liquid flows down from the downstream side end 230 of the cleaning liquid holding surface 202 in the movement direction of the head, and a region in which the coating layer 216 of the cleaning liquid is not formed occurs between the nozzle surface 114A and the cleaning liquid holding surface 202. The arrow in the left obliquely downward direction shown in FIG. 8 indicates a direction of the cleaning liquid flowing down from the downstream side end 230 in the head movement direction of the cleaning liquid holding surface 202. That is, when the cleaning liquid is supplied to the nozzle surface while the head is moved, the cleaning liquid is dragged by the movement of the head to flow down toward the obliquely downward direction, and thus there may be a case in which the coating layer 216 of the cleaning liquid is not formed in a region shown in FIG. 8 as dot hatches.

Consequently, the head cleaning unit 200 according to the present invention is optimized so that the arrangement of the cleaning liquid supply nozzle 204 satisfies a predetermined condition, whereby the cleaning liquid supplied from the cleaning liquid supply nozzle 204 to the cleaning liquid holding surface 202 reaches the entirety of the lower side end 218, and thus a region to which the cleaning liquid is not supplied is prevented from being generated.

Figure 9:
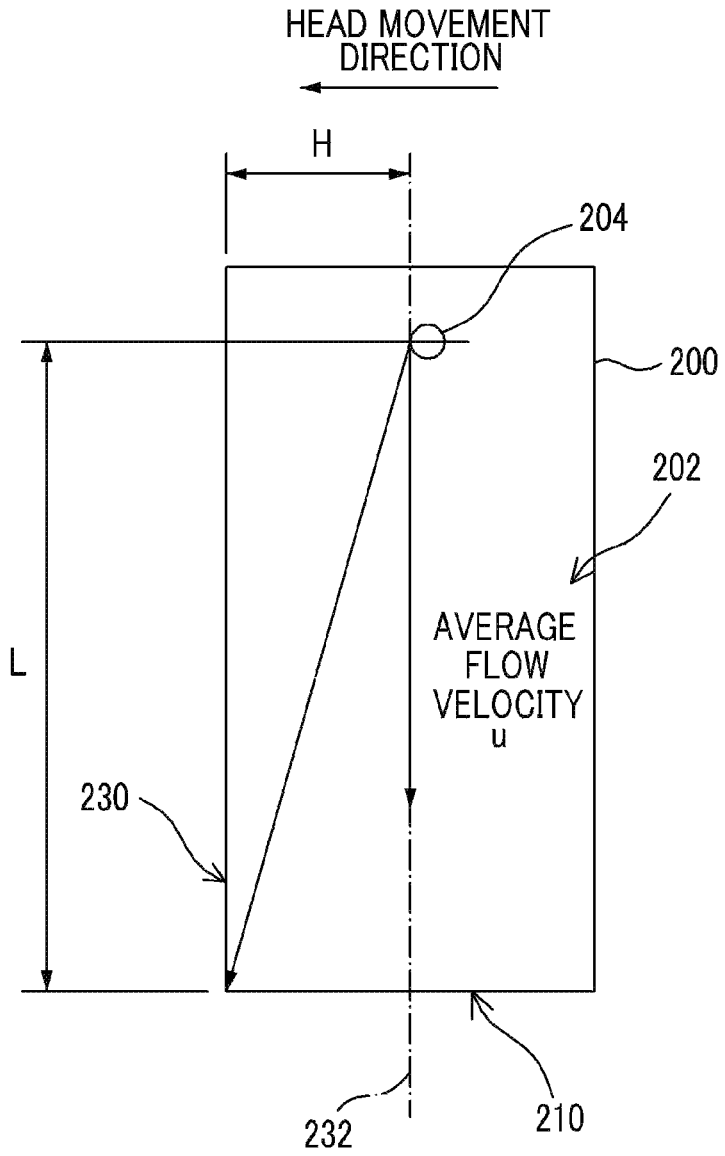
FIG. 9 is a schematic diagram illustrating an arrangement example of the cleaning liquid nozzle shown in FIG. 6.

FIG. 9 is a diagram illustrating an arrangement example of the optimization of the cleaning liquid supply nozzle 204. The cleaning liquid supply nozzle 204 shown in the same drawing is disposed at the upstream side in the head movement direction from a central position 232 in the same direction of the cleaning liquid holding surface 202. That is, the outer edge of the cleaning liquid supply nozzle 204 in the same direction (left in the drawing) is disposed at the upstream side in the same direction from the central position 232 in the head movement direction of the cleaning liquid holding surface 202, so that the entire cleaning liquid reaches the lower side end 218 even when the flow parallel to the movement direction of the head occurs in the cleaning liquid. Therefore, the cleaning liquid is supplied to a necessary region of the nozzle surface 114A.

The arrangement position of the cleaning liquid supply nozzle 204 is appropriately set by the conditions such as the viscosity of the cleaning liquid, the inclination angle of the cleaning liquid holding surface 202, the surface roughness (contact angle of the cleaning liquid with respect to the cleaning liquid holding surface 202) of the cleaning liquid holding surface 202, the contact angle of the cleaning liquid with respect to the nozzle surface 114A, and the gap between the nozzle surface 114A and the cleaning liquid holding surface 202, in addition to the values of the distance (rear end length) H (m) from the downstream side end 230 to the central position 232 in the head movement direction of the cleaning liquid holding surface 202, the distance L (m) from the center of the cleaning liquid supply nozzle 204 to the lower side end 218 in the inclination direction of the cleaning liquid holding surface 202, the average flow velocity u (m/sec) of the cleaning liquid in the cleaning liquid holding surface 202, and the head movement velocity v (m/sec).

Although the aspect in which the cleaning liquid supply nozzle 204 is provided just near the central position 232 in the head movement direction of the cleaning liquid holding surface 202 is exemplified in FIG. 9, an aspect in which the cleaning liquid supply nozzle 204 is provided in the vicinity of the upstream side end 234 in the head movement direction of the cleaning liquid holding surface 202 can also be applied.

According to the ink jet recording apparatus 10 provided with the head cleaning unit 200 having the configuration as mentioned above, in the head cleaning unit 200 that supplied the cleaning liquid to the nozzle surface 114A of the head 100, the outer edge of the cleaning liquid supply nozzle 204 in the head movement direction is disposed at the upstream side in the same direction from the central position 232 in the same direction of the cleaning liquid holding surface 202. Therefore, even when the cleaning liquid is supplied to the nozzle surface 114A while the head 100 is moved, the cleaning liquid drops from the downstream side end 230 of the cleaning liquid holding surface 202 in the head movement direction, a region to which the cleaning liquid is not supplied is prevented from being generated in the nozzle surface 114A, and thus preferable cleaning of the nozzle surface 114A is realized.

In the present example, although the aspect in which the opening shape of the cleaning liquid supply nozzle 204 is circular is exemplified, the opening shape of the cleaning liquid supply nozzle 204 is not limited to the circular shape, and may be formed to be a polygon shape such as a quadrangle or an ellipse. In addition, an aspect is also preferable in which a plurality of cleaning liquid supply nozzles 204 is included, and the plurality of cleaning liquid supply nozzles 204 is arranged in the movement direction of the head 100.

In addition, in the present example, although the aspect in which one cleaning liquid supply nozzle 204 is included is exemplified, an aspect in which a plurality of cleaning liquid supply nozzles 204 is included can also be applied. In such an aspect, the optimum arrangement of the cleaning liquid supply nozzle 204 is determined based on the cleaning liquid supply nozzle 204 on the utmost downstream side in the head movement direction.

The head cleaning unit 200 shown in the present example is configured to correspond to one head 100. When the cleaning liquid supply process is performed on a plurality of heads, the cleaning liquid supply process may be performed head by head using one head cleaning unit 200, and the cleaning liquid supply process may be simultaneously performed on a plurality of heads 100 using a plurality of head cleaning units 200.

In addition, in the present example, although the head cleaning unit 200 configured to be included in the ink jet recording apparatus 10 is shown, the head cleaning unit 200 can also be formed as a separate device independent of the ink jet recording apparatus 10.

[First Application Example]

Next, as a first application example of the above-mentioned embodiment, an aspect in which a head cleaning unit 300 is provided with a cleaning liquid application unit 308 having an integral structure corresponding to a plurality of heads will be described. Although the head cleaning unit 200 (see FIGS. 7 to 9) previously described is provided with the cleaning liquid application unit 208 configured to be capable of supplying the cleaning liquid to one head with one-time processing corresponding to one head, the configuration capable of performing the cleaning liquid supply process simultaneously and collectively on a plurality of heads can also be applied.

Figure 10:
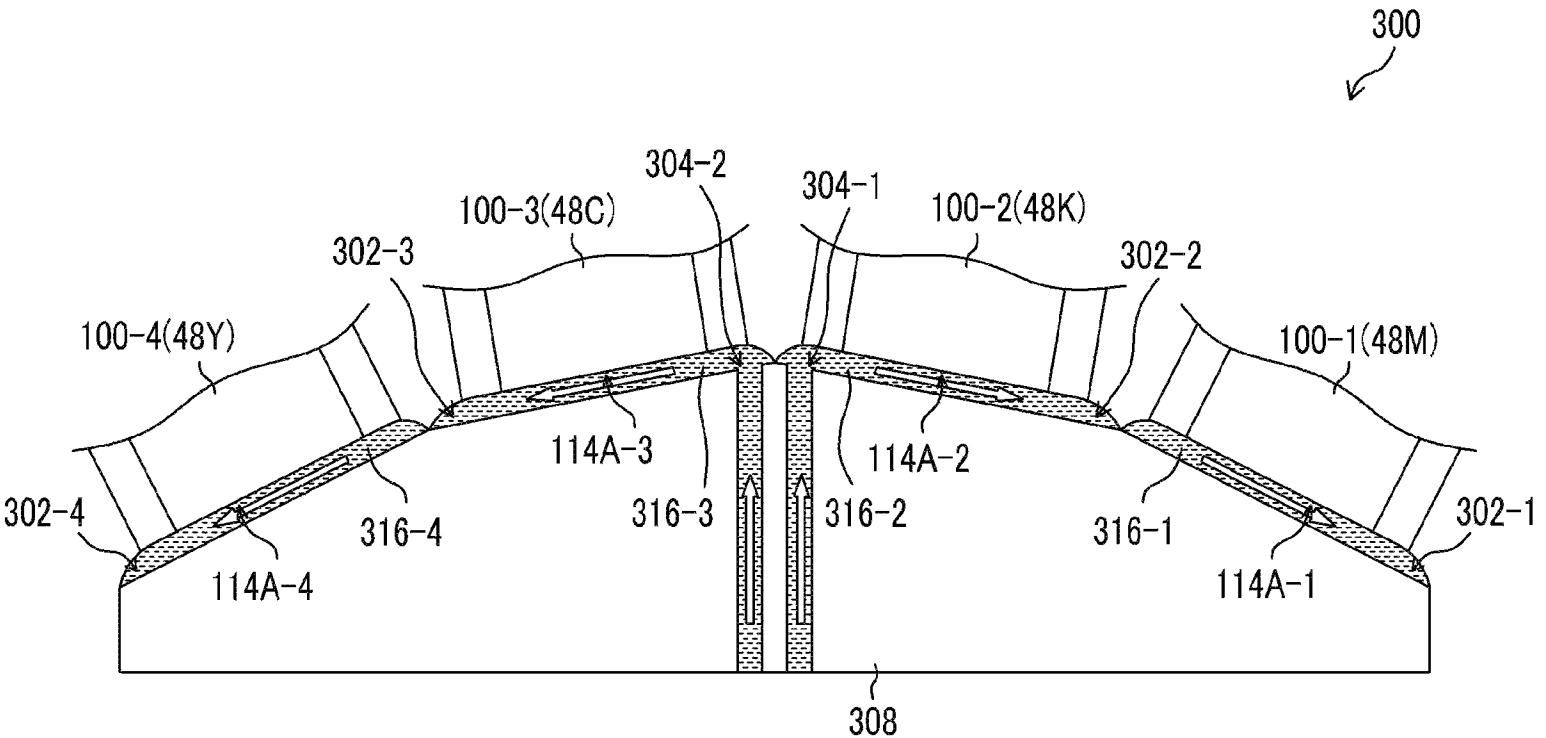
FIG. 10 is a diagram schematically illustrating a schematic configuration of a head cleaning device according to a first application example of the present invention.

FIG. 10 is a diagram illustrating a schematic configuration of the cleaning liquid application unit 308 having an integral structure corresponding to four heads 100-1, 100-2, 100-3, and 100-4. The cleaning liquid application unit 308 shown in the same drawing includes cleaning liquid holding surfaces 302-1, 302-2, 302-3, and 300-4 corresponding to each of four heads 100-1, 100-2, 100-3, and 100-4, is provided with a cleaning liquid supply nozzle 304-1 that supplies the cleaning liquid to the cleaning liquid holding surfaces 302-1 and 302-2 on the upper side end of the inclination of the cleaning liquid holding surface 302-2, and is provided with a cleaning liquid supply nozzle 304-2 that supplies the cleaning liquid to the cleaning liquid holding surfaces 302-3 and 302-4 on the upper side end of the cleaning liquid holding surface 302-3.

The cleaning liquid holding surfaces 302-1, 302-2, 302-3, and 300-4 shown in the same drawing have inclinations corresponding to the inclination angles of nozzle surfaces 114A-1, 114A-2, 114A-3, and 114A-4 of the heads 100-1, 100-2, 100-3, and 100-4, respectively. The cleaning liquid holding surface 302-1 and the cleaning liquid holding surface 302-2 are a continuous surface, and the cleaning liquid holding surface 302-3 and the cleaning liquid holding surface 302-4 are a continuous surface. The cleaning liquid supplied from the cleaning liquid supply nozzle 304-1 forms a coating layer 316-2 between the head 100-2 (nozzle surface 114A-2) and the cleaning liquid holding surface 302-2, and forms a coating layer 316-1 between the head 100-1 (nozzle surface 114A-1) and the cleaning liquid holding surface 302-1.

Similarly, the cleaning liquid supplied from the cleaning liquid supply nozzle 304-2 forms a coating layer 316-3 between the head 100-3 (nozzle surface 114A-3) and the cleaning liquid holding surface 302-3, and forms a coating layer 316-4 between the head 100-4 (nozzle surface 114A-4) and the cleaning liquid holding surface 302-4. The white arrow shown in FIG. 10 indicates the flow direction of the cleaning liquid.

According to the head cleaning unit 300 having such a structure, the cleaning liquid supply process can be simultaneously performed on a plurality of heads, and the maintenance time can be considerably shortened. In the present application example, although the cleaning liquid application unit 308 capable of collectively performing the cleaning liquid supply process on all of the heads 100-1 to 100-4 is shown, the configuration can also be applied which includes two cleaning liquid application units 308 which is composed of a cleaning liquid application unit 308-1 corresponding to the heads 100-1 and 100-2 and a cleaning liquid application unit 308-2 corresponding to the heads 100-3 and 100-4, obtained by dividing such a cleaning liquid application unit 308 into two pieces.

[Second Application Example]

Figure 11:
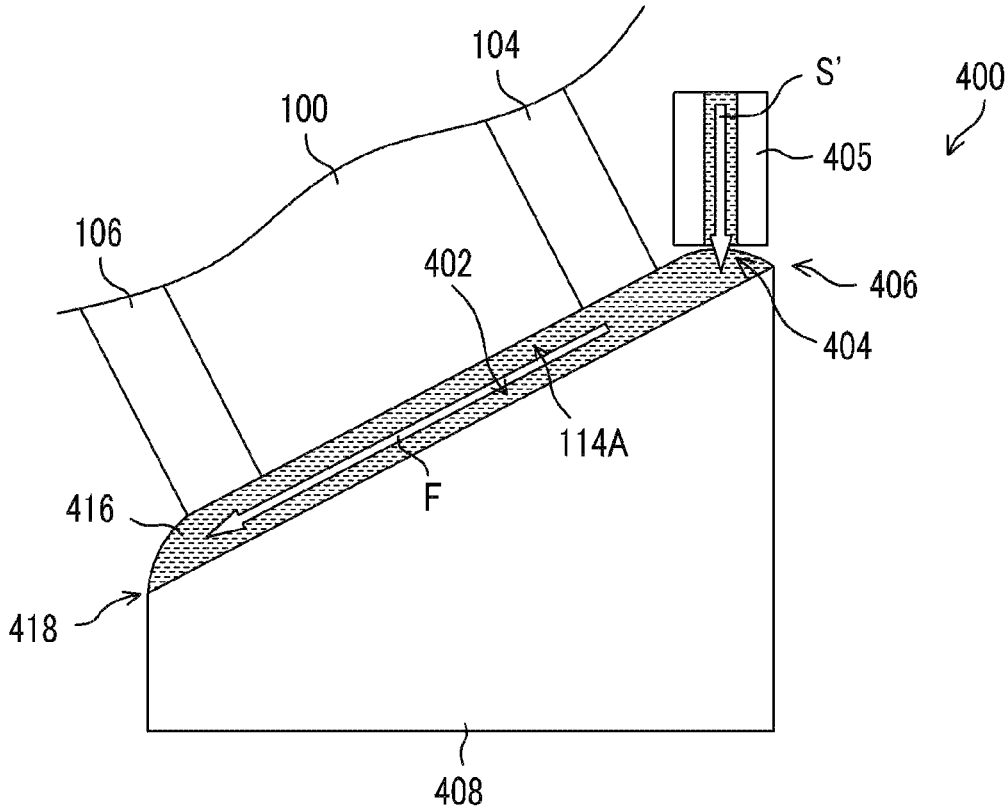
FIG. 11 is a diagram schematically illustrating a schematic configuration of a head cleaning device according to a second application example of the present invention.

Next, a head cleaning unit 400 according to a second application example of the present invention will be described. FIG. 11 is a schematic configuration diagram illustrating the head cleaning unit 400 which is configured to supply the cleaning liquid from the side (the nozzle surface 114A side of the head 100) opposite to a cleaning liquid holding surface 402 of a cleaning liquid application unit 408 to the cleaning liquid holding surface 402.

The head cleaning unit 400 shown in the same drawing is provided with a cleaning liquid supply unit 405 at a position opposed to the cleaning liquid holding surface 402 in the upper portion of the inclination of the cleaning liquid holding surface 402. A cleaning liquid supply nozzle 404 is provided on the surface opposed to the cleaning liquid holding surface 402 of the cleaning liquid supply unit 405. The white arrow shown in FIG. 11 as sign S' indicates the movement direction (downward direction in FIG. 11) of the cleaning liquid within the cleaning liquid supply unit 405.

Meanwhile, although not shown in FIG. 11, the cleaning liquid tank 210, the supply pump 212, the recovery tray 220, the recovery pump 224, the filter 226, and the like which are shown in FIG. 7 are provided accompanied by the cleaning liquid supply unit 405 shown in FIG. 11. The cleaning liquid application unit 408 shown in FIG. 11 has the same structure as that of the cleaning liquid application unit 408 shown in FIG. 7, except that the cleaning liquid is supplied from the surface opposed to the cleaning liquid holding surface 402. A small amount of the cleaning liquid is supplied from the cleaning liquid supply nozzle 404 between the nozzle surface 114A and the cleaning liquid holding surface 402, the cleaning liquid moves from the upper side end 406 of the inclination to the lower side end 418 thereof while wetting and spreading between the nozzle surface 114A and the cleaning liquid holding surface 402, and a coating layer 416 of the cleaning liquid is formed.

In the head cleaning unit 400 having such a structure, the position in the head movement direction between the cleaning liquid holding surface 402 and the cleaning liquid supply nozzle 404 (cleaning liquid supply unit 405) is optimized. That is, the outer edge on the downstream side in the head movement direction of the cleaning liquid supply nozzle 404 is disposed at the upstream side in the same direction from the central position in the same direction of the cleaning liquid holding surface 402.

In the present example, although the ink jet recording apparatus forming the color image on the recording medium is described, the range of application of the present invention is not limited to a so-called graphic printing apparatus, and can be applied to an industrial resist coating device, a liquid ejection device including an ink jet type head such as a fine pattern forming device, and an image forming apparatus.

In addition, the range of application of the present invention is not limited to the above-mentioned embodiment and application examples, and changes, additions, and omissions of the components can be appropriately made.

[Appendix]

As can be seen from the description of the above-mentioned embodiment, various technical spirits including appendices shown below are disclosed in the present specification.

(Appendix 1) There is provided a head cleaning device including: cleaning liquid holding unit that includes a cleaning liquid holding surface which is inclined with respect to a horizontal plane, corresponding to a liquid ejection surface of an ink jet head inclined with respect to a horizontal plane, and has a structure in which the cleaning liquid holding surface and the liquid ejection surface are disposed so as to have a predetermined gap therebetween, in a state where the cleaning liquid holding surface and the liquid ejection surface face each other; relative movement unit that relatively moves the cleaning liquid holding unit within a surface approximately parallel to the cleaning liquid holding surface, while the liquid ejection surface of the ink jet head and the cleaning liquid holding surface face each other, and the predetermined gap between the liquid ejection surface and the cleaning liquid holding surface is constantly maintained; and cleaning liquid supply unit that includes a cleaning liquid supply port for supplying cleaning liquid from the upper portion of an inclination of the cleaning liquid holding surface to the cleaning liquid holding surface, in a state where the cleaning liquid holding surface and the liquid ejection surface face each other, wherein the cleaning liquid supply unit has a structure in which the outer edge on the downstream side in a movement direction, when the cleaning liquid holding unit of the cleaning liquid supply port is fixed and the ink jet head is moved, is disposed further to the upstream side than the center in the movement direction of the cleaning liquid holding surface.

According to the present invention, the cleaning liquid supplied from the cleaning liquid supply port to the cleaning liquid holding surface is drawn to the relative movement direction by the relative movement of the ink jet head and the cleaning liquid holding unit, not to thereby flow out from the end of the cleaning liquid holding surface in the relative movement direction, a meniscus is formed between the cleaning liquid holding surface and the liquid ejection surface from the upper portion of the inclination of the cleaning liquid holding surface to the lower portion thereof, and thus a preferable supply of the cleaning liquid to the liquid ejection surface is realized.

An example of the movement direction of the relative movement unit includes an aspect in which the cleaning liquid holding unit is fixed and the ink jet head is moved with respect to the cleaning liquid holding unit. In addition, in an aspect including a long ink jet head, an aspect in which the ink jet head is moved in the longitudinal direction is included.

As a planar shape of the cleaning liquid supply port, shapes such as a circular shape, an elliptical shape, and a quadrangle shape can be applied. In addition, an aspect in which a plurality of cleaning liquid supply ports is included can also be applied.

(Appendix 2) In the head cleaning device according to Appendix 1, the cleaning liquid supply port is disposed at a position in which the length H from a position of the outer edge on the downstream side of the cleaning liquid supply port in the movement direction to the end on the downstream side of the cleaning liquid holding surface in the movement direction is more than twice the length from the position of the outer edge on the downstream side of the cleaning liquid supply port in the movement direction to the end on the upstream side of the cleaning liquid holding surface in the movement direction.

According to such an aspect, the cleaning liquid supply port is disposed so that the length H from a position of the outer edge on the downstream side of the cleaning liquid supply port in the movement direction to the end on the downstream side of the cleaning liquid holding surface in the movement direction becomes larger, so that the cleaning liquid can be prevented from flowing out from the downstream side end of the cleaning liquid holding surface in the movement direction even when the liquid moves in the relative movement direction of the head and the cleaning liquid holding unit.

For example, the length from the cleaning liquid supply port to the end on the upstream side to the length from the downstream side end to the cleaning liquid supply port is set to ½ with respect to the movement direction of the cleaning liquid holding surface.

(Appendix 3) In the head cleaning device according to Appendix 1 or 2, the cleaning liquid supply port is provided on the cleaning liquid holding surface.

According to such an aspect, the cleaning liquid supply unit and the cleaning liquid holding unit can be integrally formed, which results in space saving.

(Appendix 4) In the head cleaning device according to any one of Appendices 1 to 3, the length of the cleaning liquid holding surface in an inclination direction is equal to or more than the length of an ink jet head to be cleaned in an inclination direction.

According to such an aspect, the cleaning liquid can be uniformly supplied to the entire region of the ink jet head in the inclination direction.

(Appendix 5) In the head cleaning device according to any one of Appendices 1 to 4, the cleaning liquid holding unit has a plurality of cleaning liquid holding surfaces corresponding to a plurality of heads.

According to such an aspect, the cleaning liquid supply process can be simultaneously performed on a plurality of ink jet heads, and the processing time of the cleaning liquid supply can be shortened.

(Appendix 6) In the head cleaning device according to any one of Appendices 1 to 5, the length of the cleaning liquid holding surface in the inclination direction is equal to or more than the length in a lateral direction of a line-type ink jet head provided with a plurality of nozzles over the length corresponding to the maximum width of a recording medium, and the relative movement unit moves the line-type ink jet head at a predetermined velocity with respect to the cleaning liquid holding unit, in a longitudinal direction of the line-type ink jet head.

According to such an aspect, the cleaning liquid can be supplied to the entirety of the liquid ejection surface of the line-type head with one-time processing, and shortening of the processing time can be expected.

(Appendix 7) There is provided an image forming apparatus including: an ink jet head in which a liquid ejection surface is disposed inclined with respect to a horizontal plane; a head cleaning device that applies cleaning liquid to the liquid ejection surface of the ink jet head, includes a cleaning liquid holding surface inclined with respect to a horizontal plane, corresponding to the liquid ejection surface of the ink jet head, and includes cleaning liquid holding unit having a structure in which the cleaning liquid holding surface and the liquid ejection surface are disposed so as to have a predetermined gap therebetween, in a state where the cleaning liquid holding surface and the liquid ejection surface face each other; and relative movement unit that relatively moves the cleaning liquid holding unit and the ink jet head within a surface approximately parallel to the cleaning liquid holding surface, while the liquid ejection surface of the ink jet head and the cleaning liquid holding surface face each other, and the predetermined gap between the liquid ejection surface and the cleaning liquid holding surface is constantly maintained, wherein the head cleaning device includes cleaning liquid supply unit that includes a cleaning liquid supply port for supplying cleaning liquid from the upper portion of an inclination of the cleaning liquid holding surface to the cleaning liquid holding surface, in a state where the cleaning liquid holding surface and the liquid ejection surface face each other, and the cleaning liquid supply unit has a structure in which the outer edge on the downstream side in a movement direction, when the cleaning liquid holding unit of the cleaning liquid supply port is fixed and the ink jet head is moved, is disposed further to the upstream side than the center in the movement direction of the cleaning liquid holding surface.

An ink jet recording apparatus which ejects ink from the ink jet head to form an image on the recording medium is included in an image forming apparatus.

(Appendix 8) In the image forming apparatus according to Appendix 7, the image forming apparatus further includes: recording medium transport unit, having a recording medium fixing member provided with a recording medium fixing region for fixing a recording medium to a cylindrical outer circumference surface, that rotates the recording medium fixing member around a cylindrical rotary shaft to transport the recording medium in a predetermined direction; and a plurality of ink jet heads, corresponding to each of a plurality of liquids, which are disposed inclined with respect to a horizontal plane at a position opposite to an outer circumference surface of the recording medium fixing member along the outer circumference surface, wherein the cleaning liquid holding unit includes a plurality of cleaning liquid holding surfaces having different inclinations, corresponding to each of the plurality of ink jet heads.

In such an aspect, an aspect is preferable in which the same number of cleaning liquid holding surfaces as the ink jet heads is included corresponding to all of the ink jet heads mounted in the apparatus.

(Appendix 9) There is provided a head cleaning method including: a relative movement step of relatively moving a cleaning liquid holding surface which is inclined with respect to a horizontal plane, corresponding to a liquid ejection surface of an ink jet head inclined with respect to a horizontal plane, and is disposed so as to have a predetermined gap from the liquid ejection surface in a state of facing the liquid ejection surface, and the ink jet head, within a surface approximately parallel to the cleaning liquid holding surface while the predetermined gap is maintained; and a cleaning liquid supply step of causing cleaning liquid to be supplied from a cleaning liquid supply port in which the outer edge on the downstream side in a movement direction, when the cleaning liquid holding surface is fixed and the ink jet head is moved, is disposed so as to be located further to the upstream side than the center in the movement direction of the cleaning liquid holding surface, and causing the cleaning liquid supplied to the cleaning liquid holding surface to slide down an inclination of the cleaning liquid holding surface from the upper portion of the inclination of the cleaning liquid holding surface to the lower portion thereof, while the cleaning liquid comes into contact with the liquid ejection surface.

What is claimed is:

1. A head cleaning device comprising:

a cleaning liquid holding unit that includes a cleaning liquid holding surface which is inclined with respect to a horizontal plane, corresponding to a liquid ejection surface of an ink jet head inclined with respect to a horizontal plane, and has a structure in which the cleaning liquid holding surface and the liquid ejection surface are disposed so as to have a gap therebetween, in a state where the cleaning liquid holding surface and the liquid ejection surface face each other;

a relative movement unit that relatively moves the inkjet head with respect to the cleaning liquid holding unit, while the liquid ejection surface of the ink jet head and the cleaning liquid holding surface face each other, and the gap between the liquid ejection surface and the cleaning liquid holding surface is constantly maintained; and a cleaning liquid supply unit that includes a cleaning liquid supply port for supplying cleaning liquid from the upper portion of an inclination of the cleaning liquid holding surface to the cleaning liquid holding surface, in a state where the cleaning liquid holding surface and the liquid ejection surface face each other, wherein, with respect to a movement direction of the ink jet head relative to the cleaning liquid holding unit, an outer edge of the cleaning liquid supply port is disposed:

at the center of the cleaning liquid holding surface in the ink jet head movement direction, or further to the upstream side from the center of the cleaning liquid holding surface, said upstream side being determined as upstream with respect to the ink jet head movement direction.

2. The head cleaning device according to claim 1, wherein the cleaning liquid supply port is disposed at a position in which the length H from a position of the outer edge on the downstream side of the cleaning liquid supply port in the movement direction to the end on the downstream side of the cleaning liquid holding surface in the movement direction is more than twice the length from the position of the outer edge on the downstream side of the cleaning liquid supply port in the movement direction to the end on the upstream side of the cleaning liquid holding surface in the movement direction.

3. The head cleaning device according to claim 1, wherein the cleaning liquid supply port is provided on the cleaning liquid holding surface.

4. The head cleaning device according to claim 1, wherein the length of the cleaning liquid holding surface in an inclination direction is equal to or more than the length of an ink jet head to be cleaned in an inclination direction.

5. The head cleaning device according to claim 1, wherein the cleaning liquid holding unit has a plurality of cleaning liquid holding surfaces corresponding to a plurality of heads.

6. The head cleaning device according to claim 1, wherein the length of the cleaning liquid holding surface in the inclination direction is equal to or more than the length in a lateral direction of a line-type ink jet head provided with a plurality of nozzles over the length corresponding to the maximum width of a recording medium, and the relative movement unit moves the line-type ink jet head at a predetermined velocity with respect to the cleaning liquid holding unit, in a longitudinal direction of the line-type ink jet head.

7. An image forming apparatus comprising:

an ink jet head in which a liquid ejection surface is disposed inclined with respect to a horizontal plane;

a head cleaning device that applies cleaning liquid to the liquid ejection surface of the ink jet head, includes a cleaning liquid holding surface inclined with respect to a horizontal plane, corresponding to the liquid ejection surface of the ink jet head, and includes cleaning liquid holding unit having a structure in which the cleaning liquid holding surface and the liquid ejection surface are disposed so as to have a gap therebetween, in a state where the cleaning liquid holding surface and the liquid ejection surface face each other; and relative movement unit that relatively moves the cleaning liquid holding unit and the ink jet head, while the liquid ejection surface of the ink jet head and the cleaning liquid holding surface face each other, and the gap between the liquid ejection surface and the cleaning liquid holding surface is constantly maintained, wherein the head cleaning device includes cleaning liquid supply unit that includes a cleaning liquid supply port for supplying cleaning liquid from the upper portion of an inclination of the cleaning liquid holding surface to the cleaning liquid holding surface, in a state where the cleaning liquid holding surface and the liquid ejection surface face each other, and wherein, with respect to a movement direction of the inkjet head relative to the cleaning liquid holding unit, an outer edge of the cleaning liquid supply port is disposed:

at the center of the cleaning liquid holding surface in the ink jet head movement direction, or further to the upstream side from the center of the cleaning liquid holding surface, said upstream side being determined as upstream with respect to the ink jet head movement direction.

8. The image forming apparatus according to claim 7, further comprising:

recording medium transport unit, having a recording medium fixing member provided with a recording medium fixing region for fixing a recording medium to a cylindrical outer circumference surface, that rotates the recording medium fixing member around a cylindrical rotary shaft to transport the recording medium in a predetermined direction; and a plurality of ink jet heads, corresponding to each of a plurality of liquids, which are disposed inclined with respect to a horizontal plane at a position opposite to an outer circumference surface of the recording medium fixing member along the outer circumference surface, wherein the cleaning liquid holding unit includes a plurality of cleaning liquid holding surfaces having different inclinations, corresponding to each of the plurality of ink jet heads.

9. A head cleaning method comprising:

a relative movement step of relatively moving a cleaning liquid holding surface which is inclined with respect to a horizontal plane, corresponding to a liquid ejection surface of an ink jet head inclined with respect to a horizontal plane, and is disposed so as to have a gap from the liquid ejection surface in a state of facing the liquid ejection surface, and the ink jet head, while the gap is maintained; and a cleaning liquid supply step of causing cleaning liquid to be supplied from a cleaning liquid supply port which is arranged such that, with respect to a movement direction of the ink jet head relative to the cleaning liquid holding surface, an outer edge of the cleaning liquid supply port is disposed so as to be located:

at the center of the cleaning liquid holding surface in the ink jet head movement direction, or further to the upstream side from the center of the cleaning liquid holding surface, said upstream side being determined as upstream with respect to the ink jet head movement direction, and causing the cleaning liquid supplied to the cleaning liquid holding surface to slide down an inclination of the cleaning liquid holding surface from the upper portion of the inclination of the cleaning liquid holding surface to the lower portion thereof, while the cleaning liquid comes into contact with the liquid ejection surface.

* * * * *